US009805663B2

(12) United States Patent
Kawaguchi

(10) Patent No.: US 9,805,663 B2
(45) Date of Patent: Oct. 31, 2017

(54) IMAGE PROCESSING DEVICE AND IMAGE PROCESSING METHOD

(71) Applicant: Renesas Electronics Corporation, Kawasaki-shi (JP)

(72) Inventor: Hirofumi Kawaguchi, Kawasaki (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 144 days.

(21) Appl. No.: 14/797,096

(22) Filed: Jul. 11, 2015

(65) Prior Publication Data

US 2016/0035286 A1 Feb. 4, 2016

(30) Foreign Application Priority Data

Jul. 30, 2014 (JP) ..... 2014-154710

(51) Int. Cl.

*G09G 5/00* (2006.01)
*G09G 3/34* (2006.01)
*G09G 3/36* (2006.01)

(52) U.S. Cl.

CPC ..... *G09G 3/3406* (2013.01); *G09G 3/36* (2013.01); *G09G 3/3611* (2013.01); *G09G 3/342* (2013.01);

(Continued)

(58) Field of Classification Search

CPC ..... G09G 3/36; G09G 3/342; G09G 3/3406; G09G 3/3611; G09G 2320/062;

(Continued)

(56) References Cited

U.S. PATENT DOCUMENTS 5,294,986 A * 3/1994 Tsuji ..... G06F 17/18 348/672
5,638,136 A * 6/1997 Kojima ..... H04N 5/2351 348/652

(Continued)

FOREIGN PATENT DOCUMENTS

EP 1 858 001 A1 11/2007
EP 2 096 623 A1 9/2009

(Continued)

OTHER PUBLICATIONS

Extended European Search Report dated Jan. 11, 2016.

*Primary Examiner* — Prabodh M Dharia
(74) *Attorney, Agent, or Firm* — McGinn IP Law Group, PLLC

(57) ABSTRACT

The image processing device includes a luminance modulator, a backlight control gain adjustment unit, a peak value detector, and a histogram detector. The peak value detector calculates a peak value as a maximum luminance value in a prescribed region of the video input signal inputted. The histogram detector calculates frequency distribution about the luminance value of the video input signal. Based on the peak value calculated by the peak value detector and the frequency distribution calculated by the histogram detector, the luminance modulator converts a luminance value of the video input signal into a luminance value of the video output signal and outputs the video output signal, for every pixel. The backlight control gain adjustment unit creates the backlight control signal based on the peak value.

15 Claims, 20 Drawing Sheets

(52) U.S. Cl.
CPC ..... *G09G 2320/0276* (2013.01); *G09G 2320/062* (2013.01); *G09G 2320/066* (2013.01); *G09G 2320/0646* (2013.01); *G09G 2320/0653* (2013.01); *G09G 2320/0673* (2013.01); *G09G 2330/021* (2013.01); *G09G 2360/16* (2013.01)

(58) Field of Classification Search
CPC ..... G09G 2320/066; G09G 2320/0646; G09G 2320/0653; G09G 2320/0673; G09G 2320/0276; G09G 2330/021; G09G 2360/16
USPC ..... 345/589, 596, 617, 652, 691, 212, 102; 348/578, 624, 672; 315/307
See application file for complete search history.

(56) References Cited

U.S. PATENT DOCUMENTS 6,111,607 A * 8/2000 Kameyama ..... G06T 5/009 348/255
6,198,523 B1 * 3/2001 Helbing ..... G02B 5/3025 345/101
9,124,851 B2 9/2015 Akita et al.
2005/0058341 A1 * 3/2005 Maruoka ..... G06K 9/325 382/167
2005/0140616 A1 * 6/2005 Sohn ..... G09G 3/2092 345/87
2007/0268242 A1 11/2007 Baba et al.
2008/0074372 A1 * 3/2008 Baba ..... G09G 3/3406 345/89
2009/0060388 A1 * 3/2009 Shingai ..... G06T 5/004 382/298
2009/0085929 A1 * 4/2009 Whitehead ..... G03B 21/60 345/617
2010/0079476 A1 * 4/2010 Baba ..... G09G 3/3406 345/589
2010/0283802 A1 11/2010 Jung et al.
2010/0328535 A1 * 12/2010 Okui ..... G09G 3/20 348/578
2011/0181785 A1 * 7/2011 Masuda ..... H04N 5/20 348/624
2012/0019167 A1 * 1/2012 Chen ..... H05B 33/0842 315/307
2012/0038693 A1 * 2/2012 Kang ..... H04N 9/3117 345/691
2012/0120096 A1 * 5/2012 Johnson ..... G09G 3/2048 345/596
2012/0147067 A1 * 6/2012 Hashimoto ..... G09G 3/3413 345/690
2012/0162532 A1 6/2012 Oniki et al.
2014/0340431 A1 * 11/2014 Yamakawa ..... G09G 3/3426 345/690

FOREIGN PATENT DOCUMENTS

EP 2 610 850 A1 7/2013
JP 2011-053264 A 3/2011

* cited by examiner

IMAGE PROCESSING DEVICE AND IMAGE PROCESSING METHOD

CROSS-REFERENCE TO RELATED APPLICATIONS

The disclosure of Japanese Patent Application No. 2014-154710 filed on Jul. 30, 2014 including the specification, drawings and abstract is incorporated herein by reference in its entirety.

BACKGROUND

The present invention relates to an image processing device and an image processing method, and in particular, it can be suitably applied to a liquid crystal display device with backlight control.

As a power consumption reduction technology in a liquid crystal display device (LCD) with a backlight, peak ACL (Automatic Contrast Limit) control is known. In the peak ACL control, a peak value of luminance, that is, the highest luminance in a video signal is detected, the luminance of the backlight is reduced to a necessary minimum value for the display of the peak value concerned, and luminance modulation is performed to the whole video signal such that a video signal output of a pixel with the peak value concerned becomes 100%. For example, if the luminance of the brightest pixel, that is, the peak value within a frame is 50% of the maximum luminance of the display unit, the backlight luminance is reduced to 50% and the luminance modulation is performed so as to double the video signal of the frame. The luminance displayed by a 100% backlight luminance multiplied by a 50% video signal is the same as the luminance displayed by a 50% backlight luminance multiplied by a 100% video signal. Accordingly, it is possible to reduce the power consumption of the backlight without reducing the luminance of the picture displayed.

On the other hand, a technology to compensate a video signal in order to improve the luminance in terms of human visibility is known. To the ordinary video signal, correction to compensate a gamma characteristic of a display panel (gamma correction) is performed generally. In the ordinary gamma correction, the correction is made so that the video data and the display luminance may have a proportionality relation, by offsetting the gamma characteristic of the display panel. On the other hand, it is possible to improve the luminance in terms of human visibility, by adjusting the amount of correction of the gamma correction to the direction in which the relation of the display luminance to the video data is shifted to the high luminance side from the proportionality relation as a whole. It is also possible to improve the luminance in terms of human visibility, by performing the correction so that the relation of the display luminance to the video data becomes smaller in the low luminance side and larger in the high luminance side than the proportionality relation, thereby enhancing the contrast.

Patent Document 1 discloses a display unit which aims at the improvement in the visibility of a low luminance gradation in a backlight control system for a power saving LCD. The display unit includes an APL curve setting unit which adjusts the backlight luminance based on the average luminance (APL: Average Picture Level) of a video signal; a luminance histogram modulator which modulates the backlight luminance and a gradation signal based on a luminance histogram; and a black correction unit which performs gamma correction of the modulated gradation signal (K2) based on a gamma value set in advance (refer to FIG. 2 of Patent Document 1). The black correction unit selects a gamma value in a gamma information storage unit which stores the correspondence relation of plural gamma values and the combination of the backlight luminance (D2) and the luminance signal (F), adjusted by the histogram luminance modulator. Since the optimal gamma value is calculated according to the backlight control value and the environmental illumination, it is possible to improve the visibility in a low luminance gradation.

Patent Document (Patent Document 1) Japanese Unexamined Patent Application Publication No. 2011-53264

SUMMARY

The examination on Patent Document 1 by the present inventors has revealed that there are the following new issues.

A display unit described in Patent Document 1 changes the gamma characteristic and performs control to prevent the visibility from degrading, with the aim of improvement against the visibility degradation of the low luminance gradation in the backlight control operation. Specifically, processing is performed to reduce a gamma value and to enhance the luminance of the low luminance gradation, according to the lowering of the backlight luminance, and the improvement against the visibility degradation of the low luminance gradation is achieved. Therefore, the effect is absolutely restricted only to compensating the degradation in visibility by the backlight control operation; accordingly, it is difficult to improve the visibility-wise luminance which a viewer feels.

The following explains a solution to such a problem, and the other issues and new features of the present invention will become clear from the description of the present specification and the accompanying drawings.

One embodiment according to the present application goes as follows.

An image processing device receives a video input signal and supplies a video output signal and a backlight control signal to a coupled display panel with a backlight controller. The image processing device includes a luminance modulator, a backlight control gain adjustment unit, a peak value detector, and a histogram detector. The peak value detector calculates a peak value as a maximum luminance value in a prescribed region of the video input signal inputted. The histogram detector calculates frequency distribution about the luminance value of the video input signal in the prescribed region. Based on the peak value calculated by the peak value detector and the frequency distribution calculated by the histogram detector, the luminance modulator converts a luminance value of the video input signal into a luminance value of the video output signal and outputs the video output signal, for every pixel. The backlight control gain adjustment unit creates the backlight control signal based on the peak value. Note that the prescribed region is a target region of the backlight control when the backlight control is executed for every divided region in the display panel.

The effect obtained by one embodiment described above is explained briefly as follows.

That is, it is possible to perform the peak ACL control to reduce the power consumption of the backlight, and at the same time, it is possible to improve the visibility adaptively according to the picture pattern of the video input signal.

DETAILED DESCRIPTION

1. Outline of Embodiment

Figure 1:
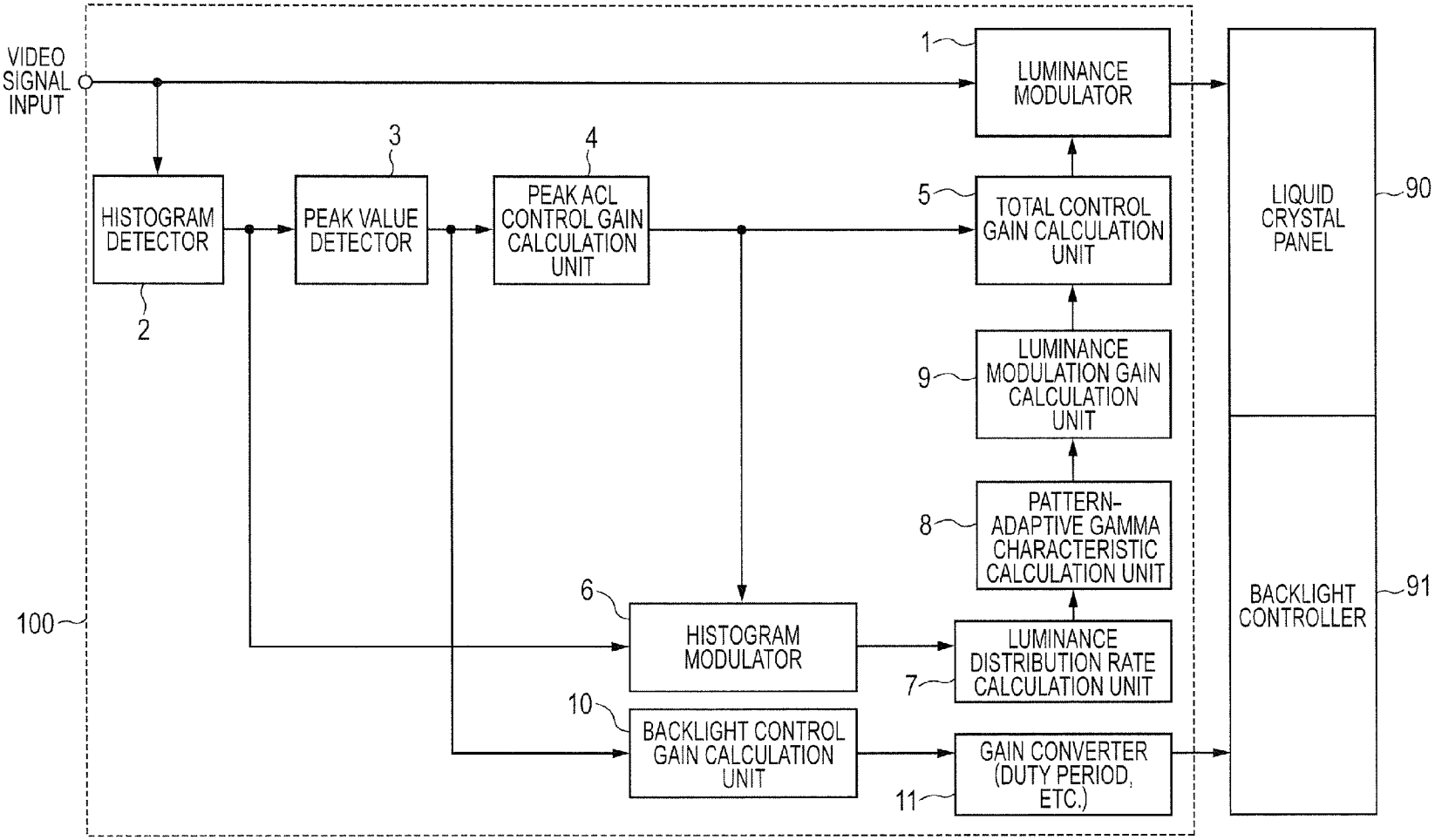
FIG. 1 is a block diagram illustrating an example of a configuration of an image processing device according to Embodiment 1.

First, an outline of a typical embodiment disclosed in the present application is explained. A numerical symbol of the drawing referred to in parentheses in the outline explanation about the typical embodiment only illustrates what is included in the concept of the component to which the numerical symbol is attached.

(1) <Pattern-Adaptive Gamma Correction>

An image processing device (100) according to a typical embodiment disclosed in the present application includes a luminance modulator which receives a video input signal and calculates a video output signal to be supplied to a coupled display panel (90); and a backlight control gain adjustment unit (10) which calculates a backlight control signal to be supplied to a backlight controller (91) provided in the display panel. The image processing device further includes a peak value detector (3) which calculates a peak value as a maximum luminance value in a prescribed region of the video input signal; and a histogram detector (2) which calculates frequency distribution about the luminance value of the video input signal in the prescribed region.

The luminance modulator converts a luminance value of the video input signal into a luminance value of the video output signal for every pixel, based on the peak value and the frequency distribution. The backlight control gain adjustment unit calculates the backlight control signal based on the peak value.

According to this configuration, it is possible to perform the peak ACL control to reduce the power consumption of the backlight, and at the same time, it is possible to improve the visibility adaptively according to the picture pattern of the video input signal. It is preferable to match the prescribed region with a target region of the backlight control when the backlight control is executed for every divided region in the display panel.

(2) <A Total Control Gain Calculation Unit>

In Paragraph 1, the image processing device further includes a peak ACL control gain calculation unit (4), a pattern-adaptive gamma characteristic calculation unit (8, 9), and a total control gain calculation unit (5).

The peak ACL control gain calculation unit calculates a peak ACL control gain with which the luminance of each pixel of the video input signal is amplified, based on the ratio of the peak value to the maximum possible value of the video output signal. The pattern-adaptive gamma characteristic calculation unit calculates a luminance modulation gain with which the luminance of each pixel of the video input signal is modulated, based on the frequency distribution. The total control gain calculation unit calculates a product of the peak ACL control gain and the luminance modulation gain as a total control gain. The luminance modulator converts the luminance value of the video input signal into the luminance value of the video output signal for every pixel based on the total control gain.

According to this configuration, it is possible to suppress the generation of a quantization error to the video input signal to a smaller amount than performing sequentially the conversion using the luminance modulation gain and the conversion using the luminance modulation gain.

(3) <Pattern-Adaptive Gamma Correction=Small Gamma/S Curve/Histogram Equalization>

In Paragraph 2, the pattern-adaptive gamma characteristic calculation unit calculates the luminance modulation gain based on at least one of a first function (81), a second function (82), and a third function (83), and on the peak value.

The first function (small gamma) has no point of inflection and enhances the luminance for every pixel of the video input signal.

The second function (S-curve correction) has one point of inflection and enhances the luminance about a high luminance pixel above a barycenter of the frequency distribution among the video input signal, and reduces the luminance about a low luminance pixel below the barycenter.

The third function (histogram equalization) linearizes the relation of a cumulative value of the frequency to a luminance value of the frequency distribution.

According to this configuration, the concrete luminance modulation function for enhancing the visibility adaptively according to the picture pattern of a video input signal is provided. It is possible to apply the luminance modulation function which is more suitable to the picture pattern of the video input signal, by use of one of or combinations of the first function (small gamma), the second function (S-curve correction), and the third function (histogram equalization), or by use of combinations with other functions.

(4) <Pattern-Adaptive Gamma Correction=Selective Application of the First, the Second, and the Third Function>

In Paragraph 3, the image processing device further includes a frequency distribution rate calculation unit (7).

When no localized distribution is observed in the frequency distribution, the frequency distribution rate calculation unit derives the first function and supplies it to the pattern-adaptive gamma characteristic calculation unit.

When the frequency distribution is locally distributed at one place, the frequency distribution rate calculation unit derives the second function and supplies it to the pattern-adaptive gamma characteristic calculation unit.

When the frequency distribution is locally distributed at several regions, the frequency distribution rate calculation unit derives the third function with which a gamma value is specified based on the cumulative value of the frequency in the frequency distribution, and supplies the third function to the pattern-adaptive gamma characteristic calculation unit.

According to this configuration, it is possible to enhance the visibility adaptively according to the picture pattern of a video input signal, by applying selectively one of the first function (small gamma), the second function (S-curve correction), and the third function (histogram equalization).

(5) <Pattern-Adaptive Gamma Correction=Mixed Application of the First, the Second, and the Third Function>

In Paragraph 3, the frequency distribution rate calculation unit derives the first function, the second function, and the third function in parallel (80), derives further a fourth function by weighting addition of the first function, the second function, and the third function (84), and supplies the fourth function to the pattern-adaptive gamma characteristic calculation unit, in lieu of the first function, the second function, and the third function.

According to this configuration, it is possible to enhance the visibility adaptively according to the picture pattern of a video input signal, by applying the function which combines the first function, the second function, and the third function.

(6) <Pattern-Adaptive Gamma Correction=Adjusting a Mixing Ratio of the First, the Second, and the Third Function>

In Paragraph 5, the frequency distribution rate calculation unit adjusts the weighting of the first function, the second function, and the third function, based on the frequency distribution.

According to this configuration, it is possible to apply the luminance modulation function more suitable to the picture pattern of a video input signal, when applying the function which combines the first function, the second function, and the third function.

(7) <Pattern-Adaptive Gamma Correction=Pretreatment for Evaluating the Frequency Distribution>

In Paragraph 4 or Paragraph 6, the frequency distribution rate calculation unit evaluates the feature of the video input signal, based on the weighted frequency distribution which is obtained by multiplying to the frequency distribution a pretreatment function specifying the weighting corresponding to the luminance value of the video input signal.

According to this configuration, it is possible to determine more exactly the feature of the picture pattern of a video input signal.

(8) <Black Level Correction>

In Paragraph 1, the image processing device further includes a bottom value detector (12) which calculates a bottom value as a minimum luminance value of the video input signal in a prescribed region. The luminance modulator converts a luminance value of the video input signal into a luminance value of the video output signal for every pixel, based on the peak value and the frequency distribution, and additionally based on the bottom value.

According to this configuration, in performing the peak ACL control to reduce the power consumption of the backlight, and at the same time, in improving the visibility adaptively according to the picture pattern of the video input signal, it is possible to enhance the visibility-wise luminance and to reduce simultaneously the luminance more in a low luminance area, thereby enhancing the contrast.

(9) <A Backlight Control Gain Reduction Calculation Unit>

In Paragraph 1, the image processing device evaluates the enhancement amount of the luminance value of the video output signal to the luminance value of the video input signal, the enhancement being performed by the luminance modulator based on the frequency distribution (15), and readjusts the backlight control signal based on the enhancement amount, the backlight control signal being created by the backlight control gain adjustment unit based on the peak value (16, 17).

According to this configuration, it is possible to perform the peak ACL control to reduce the power consumption of the backlight, and at the same time, it is possible to improve the visibility adaptively according to the picture pattern of the video input signal. Furthermore, it is possible to utilize all or a part of the enhancement amount for the purpose of suppressing the backlight power consumption. Instead of enhancing the visibility-wise luminance based on the frequency distribution, it is possible to reduce the luminance of the backlight more to enhance the reduction effect of the power consumption.

(10) <Backlight Control Gain Reduction and/or Pattern-Adaptive Gamma Correction Readjustment>

In Paragraph 1, the image processing device evaluates the enhancement amount of the luminance value of the video output signal to the luminance value of the video input signal, the enhancement being performed by the luminance modulator based on the frequency distribution (15), and readjusts the backlight control signal based on the enhancement amount (16, 17). In lieu of or combining with the readjustment, the luminance modulator converts a luminance value of the video input signal into a luminance value of the video output signal for every pixel, based on the peak value and the frequency distribution, and additionally based on the enhancement amount.

According to this configuration, it is possible to perform the peak ACL control to reduce the power consumption of the backlight, and at the same time, it is possible to improve the visibility adaptively according to the picture pattern of the video input signal. Furthermore, it is possible to utilize all or a part of the enhancement amount for the purpose of suppressing the backlight power consumption, and in lieu of or combining with the enhancement amount, it is possible to utilize it for the purpose of readjustment of the function for the pattern-adaptive gamma correction.

(11) <Local Dimming>

In one of Paragraph 1 to Paragraph 10, the backlight controller (91) adjusts a backlight luminance for every region corresponding to the prescribed region, and the backlight control gain adjustment unit calculates a backlight control signal to adjust the backlight luminance of the region corresponding to the prescribed region.

According to this configuration, it is possible to realize the power saving by a finer backlight control and to achieve the reduction of the power consumption more efficiently.

(12) <Middleware on an SOC>

In one of Paragraph 1 to Paragraph 11, the image processing device further includes a processor (30) which executes software, and the processor performs the operation of the luminance modulator and the backlight control gain adjustment unit by executing the specified software.

According to this configuration, it is possible to provide an LSI (Large Scale Integrated circuit) of an SOC (System On a Chip) which performs, by a middleware, the image processing for enhancing the visibility adaptively according to the picture pattern of the video input signal and the reduction of the power consumption by the accompanying backlight control.

(13) <An Image Processing Method Including Pattern-Adaptive Gamma Correction>

An image processing method according to a typical embodiment disclosed in the present application includes a step of modulating luminance (1) to receive a video input signal and to calculate a video output signal to be supplied to a coupled display panel (90); and a step of adjusting a backlight control gain (10) to calculate a backlight control signal to be supplied to a backlight controller (91) provided in the display panel. The image processing method further includes a step of detecting a peak value (3) to calculate a peak value as a maximum luminance value of the video input signal in a prescribed region; and a step of detecting histogram (2) to calculate frequency distribution about the luminance value of the video input signal in the prescribed region.

The step of modulating luminance converts a luminance value of the video input signal into a luminance value of the video output signal for every pixel, based on the peak value and the frequency distribution. The step of adjusting a backlight control gain calculates the backlight control signal based on the peak value.

According to this procedure, it is possible to provide the image processing method in which it is possible to perform the peak ACL control to reduce the power consumption of the backlight, and at the same time, it is possible to improve the visibility adaptively according to the picture pattern of the video input signal. It is preferable to match the prescribed region with a target region of the backlight control when the backlight control is executed for every divided region in the display panel.

(14) <Pattern-Adaptive Gamma Correction=Small Gamma/S Curve/Histogram Equalization>

In Paragraph 13, the image processing method includes a step of calculating a peak ACL control gain (4) and a step of calculating a pattern-adaptive gamma characteristic (8, 9).

The step of calculating a peak ACL control gain calculates a peak ACL control gain with which the luminance of each pixel of the video input signal is amplified, based on the ratio of the peak value to the maximum possible value of the video output signal.

The step of calculating a pattern-adaptive gamma characteristic calculates a luminance modulation gain with which the luminance of each pixel of the video input signal is modulated, based on at least one of a first function (81), a second function (82), and a third function (83), calculated based on the frequency distribution.

The first function (small gamma) has no point of inflection and enhances the luminance for every pixel of the video input signal.

The second function (S-curve correction) has one point of inflection and enhances the luminance about a high luminance pixel above a barycenter of the frequency distribution among the video input signal, and reduces the luminance about a low luminance pixel below the barycenter.

The third function (histogram equalization) linearizes the relation of an accumulated value of the frequency to a luminance value of the frequency distribution.

The step of modulating luminance converts a luminance value of the video input signal into a luminance value of the video output signal for every pixel, based on the peak ACL control gain and the luminance modulation gain.

According to this procedure, the concrete luminance modulation function for enhancing the visibility adaptively according to the picture pattern of a video input signal is provided. It is possible to apply the luminance modulation function which is more suitable to the picture pattern of the video input signal, by use of one of or combinations of the first function (small gamma), the second function (S-curve correction), and the third function (histogram equalization), or by use of combinations with other functions.

(15) <Black Level Correction>

In Paragraph 13, the image processing method further includes a step of detecting a bottom value (12) to calculate a bottom value as a minimum luminance value of the video input signal in a prescribed region. The step of modulating luminance converts a luminance value of the video input signal into a luminance value of the video output signal for every pixel, based on the peak value and the frequency distribution, and additionally based on the bottom value.

According to this procedure, in performing the peak ACL control to reduce the power consumption of the backlight, and at the same time, in improving the visibility adaptively according to the picture pattern of the video input signal, it is possible to enhance the visibility-wise luminance and to reduce simultaneously the luminance more in a low luminance area, thereby enhancing the contrast.

(16) <A Step of Calculating Backlight Control Gain Reduction>

In Paragraph 13, the image processing method evaluates the enhancement amount of the luminance value of the video output signal to the luminance value of the video input signal, the enhancement being performed in the step of modulating luminance based on the frequency distribution (15). The image processing method further includes a step of calculating backlight control gain reduction (16, 17) which readjusts the backlight control signal based on the enhancement amount, the backlight control signal being created in the step of adjusting a backlight control gain based on the peak value.

According to this procedure, it is possible to perform the peak ACL control to reduce the power consumption of the backlight, and at the same time, it is possible to improve the visibility adaptively according to the picture pattern of the video input signal. Furthermore, it is possible to utilize a part of the enhancement amount for the purpose of suppressing the backlight power consumption. Instead of enhancing the visibility-wise luminance based on the frequency distribution, it is possible to reduce the luminance of the backlight more to enhance the reduction effect of the power consumption.

(17) <Local Dimming>

In one of Paragraph 13 to Paragraph 16, the backlight controller (91) adjusts a backlight luminance for every region corresponding to the prescribed region, and the step of adjusting a backlight control gain calculates a backlight control signal which can adjust the backlight luminance of the region corresponding to the prescribed region.

According to this procedure, it is possible to realize the power saving by a finer backlight control and to achieve the reduction of the power consumption more efficiently.

(18) <Total Control Gain=Peak ACL Control Gain×Luminance Modulation Gain>

An image processing device (100) according to a typical embodiment disclosed in the present application includes a luminance modulator (1) to receive a video input signal and to calculate a video output signal to be supplied to a coupled display panel (90), and a backlight control gain adjustment unit (10) to calculate a backlight control signal to be supplied to a backlight controller (91) provided in the display panel. The image processing device further includes a peak value detector (3) to calculate a peak value as a maximum luminance value of the video input signal in a prescribed region; and a peak ACL control gain calculation unit (4) to calculate a peak ACL control gain with which the luminance of each pixel of the video input signal is amplified, based on the ratio of the peak value to the maximum possible value of the video output signal. The image processing device further includes a gamma characteristic calculation unit (8, 9) to calculate a luminance modulation gain with which the luminance of each pixel of the video input signal is modulated; and a total control gain calculation unit (5) to calculate the product of the peak ACL control gain and the luminance modulation gain as a total control gain. The luminance modulator converts the luminance value of the video input signal into the luminance value of the video output signal for every pixel based on the total control gain, and the backlight control gain adjustment unit calculates the backlight control signal based on the peak value.

According to this configuration, it is possible to suppress the generation of a quantization error to the video input signal to a smaller amount than performing sequentially the conversion using the luminance modulation gain and the conversion using the luminance modulation gain. It is preferable to match the prescribed region with a target region of the backlight control when the backlight control is executed for every divided region in the display panel.

(19) <Pattern-Adaptive Gamma Correction>

In Paragraph 18, the image processing device further includes a histogram detector (6) to calculate frequency distribution about the luminance value of the video input signal in the prescribed region. The gamma characteristic calculation unit calculates the luminance modulation gain based on the frequency distribution.

According to this configuration, it is possible to perform the peak ACL control to reduce the power consumption of the backlight, and at the same time, it is possible to improve the visibility adaptively according to the picture pattern of the video input signal.

(20) <Pattern-Adaptive Gamma Correction=Small Gamma/S Curve/Histogram Equalization>

In Paragraph 19, the gamma characteristic calculation unit calculates the luminance modulation gain based on at least one of a first function (81), a second function (82), and a third function (83).

The first function (small gamma) has no point of inflection and enhances the luminance for every pixel of the video input signal.

The second function (S-curve correction) has one point of inflection and enhances the luminance about a high luminance pixel above a barycenter of the frequency distribution among the video input signal, and reduces the luminance about a low luminance pixel below the barycenter.

The third function (histogram equalization) linearizes the relation of a cumulative value of the frequency to a luminance value of the frequency distribution.

According to this configuration, the concrete luminance modulation function for enhancing the visibility adaptively according to the picture pattern of a video input signal is provided. It is possible to apply the luminance modulation function which is more suitable to the picture pattern of the video input signal, by use of one of or combinations of the first function (small gamma), the second function (S-curve correction), and the third function (histogram equalization), or by use of combinations with other functions.

2. Details of Embodiment

Embodiment is further explained in full detail.

Embodiment 1

Pattern-Adaptive Gamma Correction

Figure 2:
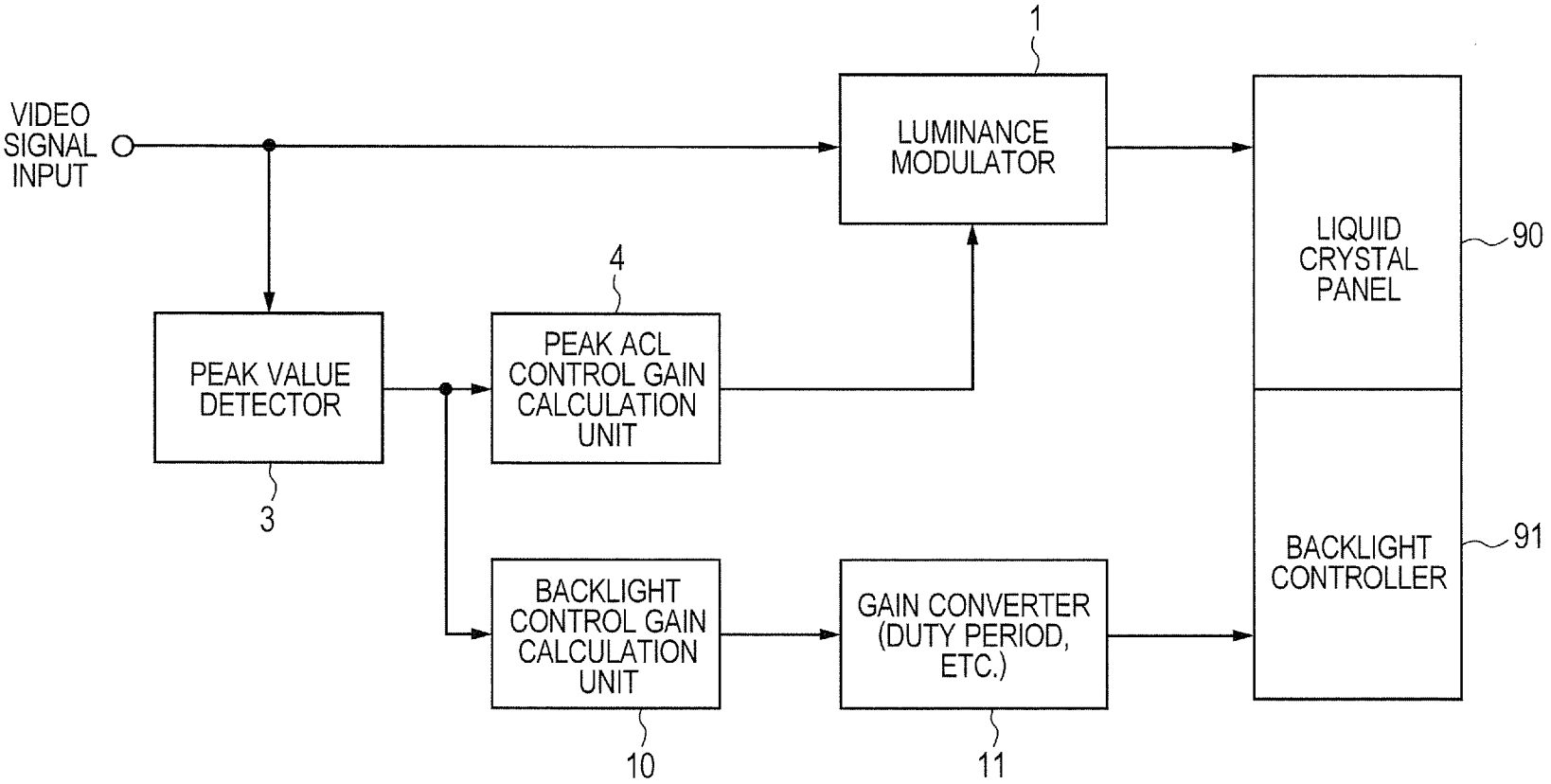
FIG. 2 is a block diagram illustrating a configuration of an image processing device of the comparative example 1.
Figure 3:
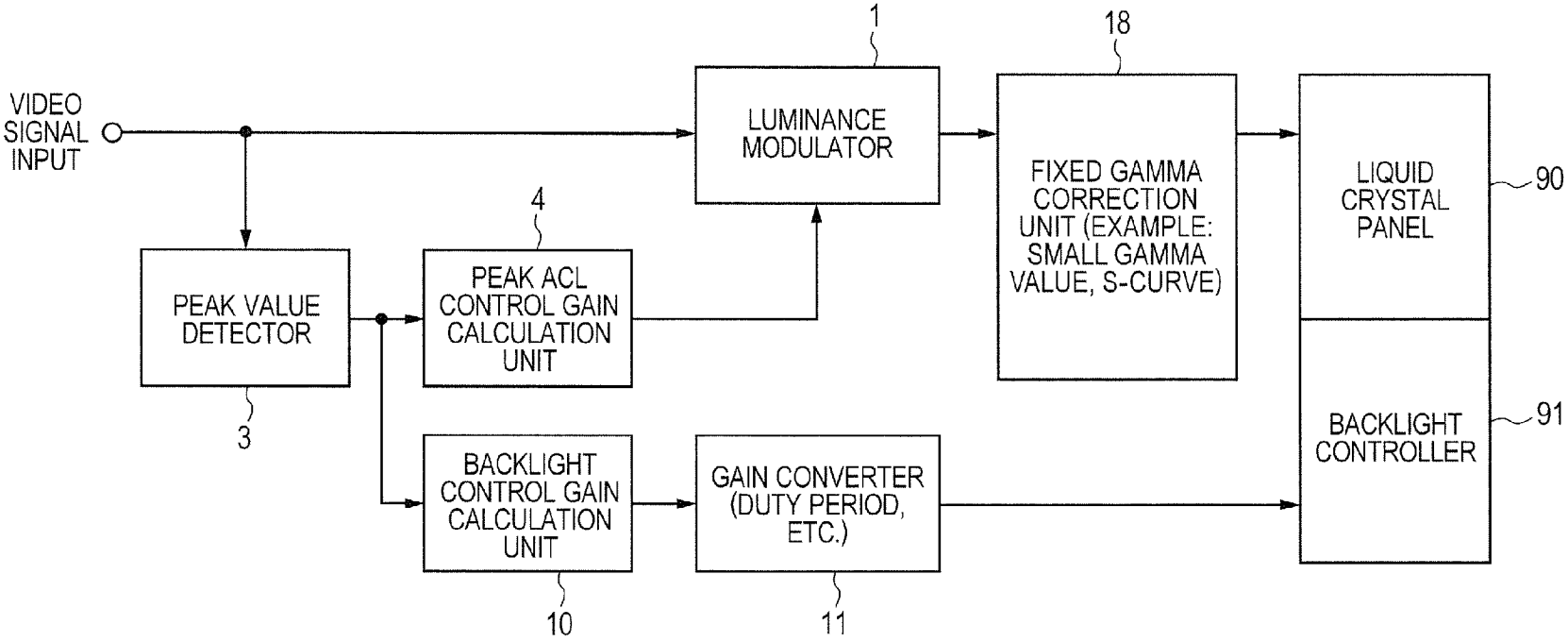
FIG. 3 is a block diagram illustrating a configuration of an image processing device of the comparative example 2.

FIG. 1 is a block diagram illustrating an example of a configuration of an image processing device according to Embodiment 1. FIG. 2 and FIG. 3 are block diagrams illustrating the configuration of image processing devices of the comparative examples 1 and 2, respectively.

Comparative Example

The image processing device of the comparative example 1 illustrated in FIG. 2 is explained. A video signal is inputted into the image processing device of the comparative example 1. The image processing device calculates a video output signal to be supplied to a coupled display panel 90 and a backlight control signal to be supplied to a backlight controller 91 attached to the display panel 90, respectively. The image processing device of the comparative example 1 includes a peak value detector 3, a peak ACL control gain calculation unit 4, a luminance modulator 1, a backlight control gain calculation unit 10, and a gain converter 11.

The peak value detector 3 detects a peak value as the highest (brightest) value in the inputted video signal. The peak ACL control gain calculation unit 4 calculates a peak ACL control gain which is the gain processing according to the detected peak value, and supplies it to the luminance modulator 1. Based on the supplied peak ACL control gain, the luminance modulator 1 performs gain processing to the inputted video signal, and outputs it to the display panel 90 as the video output signal. The backlight control gain calculation unit 10 makes the gain converter 11 execute the gain processing according to the peak value detected by the peak value detector 3. The gain converter 11 outputs a backlight control signal to the backlight controller 91.

For example, when it is assumed that the inputted video signal is comprised of pixels having luminance of 20%-50% to the full scale of 0%-100%, the peak value detected is 50%. At this time, the peak ACL control gain is set at two times and the backlight control gain is set at 0.5 times. Since the peak ACL control gain is set at two times, the video output signal is changed by the luminance modulator 1 so as to be configured with pixels having luminance of 40%-100% or twice the inputted video signal (20%-50%). On the other hand, since the backlight control gain is set at 0.5 times, the backlight controller 91 is controlled by the gain converter 11 to decrease the backlight to the luminance of 50% of the full power. Even if the liquid crystal is controlled to display with the luminance of 40%-100%, the luminance actually displayed becomes 20%-50%. This luminance distribution is the same as the luminance distribution of the inputted video signal. Accordingly, it is possible to display the inputted video signal correctly, reducing the luminance of the backlight to 50% and reducing the power consumption.

Next, the image processing device of the comparative example 2 illustrated in FIG. 3 is explained. As is the case with the comparative example 1, a video signal is inputted into the image processing device of the comparative example 2. The image processing device calculates a video output signal to be supplied to a coupled display panel 90 and a backlight control signal to be supplied to a backlight controller 91 attached to the display panel 90, respectively. The image processing device of the comparative example 2 includes a peak value detector 3, a peak ACL control gain calculation unit 4, a luminance modulator 1, a backlight control gain calculation unit 10, and a gain converter 11, and in addition, a fixed gamma correction unit 18. The configuration is the same as that of the image processing device of the comparative example 1 except that the fixed gamma correction unit 18 is additionally provided. Therefore, the explanation thereof is omitted. The fixed gamma correction unit 18 performs gamma correction to the video signal to which the peak ACL control gain processing has been performed in the luminance modulator 1, and outputs the gamma-corrected signal to the display panel 90 as the video output signal. The gamma correction which the fixed gamma correction unit 18 performs is a small gamma value characteristic and an S-curve characteristic, for example.

The gamma correction is explained.

The display panel 90 cannot display the luminance which is completely proportional to the inputted video signal, but it has the nonlinearity called a gamma characteristic. Generally the relation of the display luminance y to the inputted video signal x is denoted by $y=x^{\gamma}$, for example, and $\gamma=2.2$ in the ordinary liquid crystal panel. The gamma correction is a processing of multiplying the video signal x by an inverse function of gamma in advance in order to offset the present relation. Assuming that the inputted video signal is v and the video output signal after the gamma correction is $x=v^{(1/\gamma)}$, the luminance y displayed becomes as $y=x^{\gamma}=v^{(\gamma\times 1/\gamma)}=v$, and is compensated to the linear relation.

Figure 4:
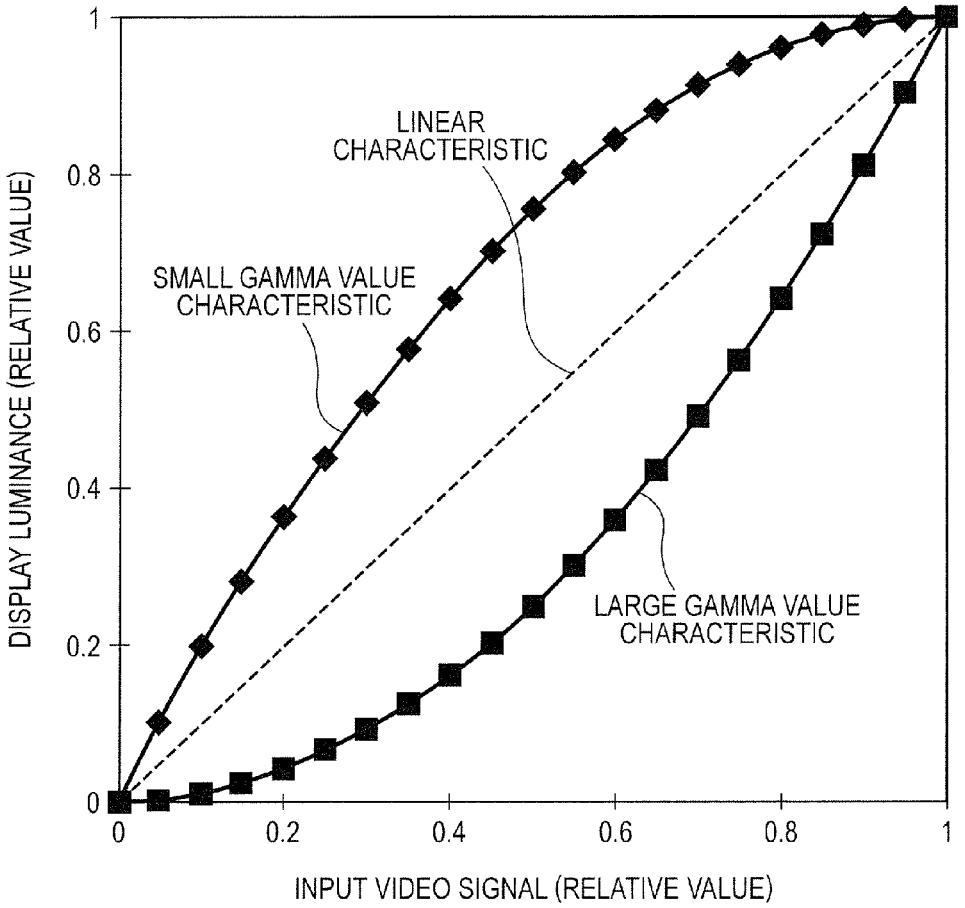
FIG. 4 is an explanatory drawing illustrating a gamma characteristic with a small gamma value and a large gamma value.

FIG. 4 is an explanatory drawing illustrating a gamma characteristic with a small gamma value and a large gamma value. The horizontal axis shows the video signal inputted and the vertical axis shows the luminance displayed, both in relative values. The relative value is a value relatively expressing the minimum luminance (black) as 0 and the maximum luminance (white) as 1. When compensated linearly as described above, the linear characteristic illustrated by a dashed line is obtained. On the other hand, by setting as $1/\gamma>1/2.2$, the display luminance y ($=v^{\gamma}$, v is the input video signal) is compensated to a small gamma value compared with the linear characteristic, such as $\gamma<1$. The present characteristic is illustrated as a "small gamma value characteristic." As compared with the linear characteristic, it becomes a convex curve. The display luminance always takes a larger value to the inputted video signal; accordingly, the visibility-wise luminance is enhanced on the whole. On the other hand, by setting as $1/\gamma<1/2.2$, the display luminance y ($=v^{\gamma}$, v is the input video signal) is compensated to a large gamma value compared with the linear characteristic, such as $\gamma>1$. The present characteristic is illustrated as a "large gamma value characteristic." As compared with the linear characteristic, it becomes a concave curve. The display luminance always takes a smaller value to the inputted video signal; accordingly, the visibility-wise luminance is reduced on the whole.

Figure 5:
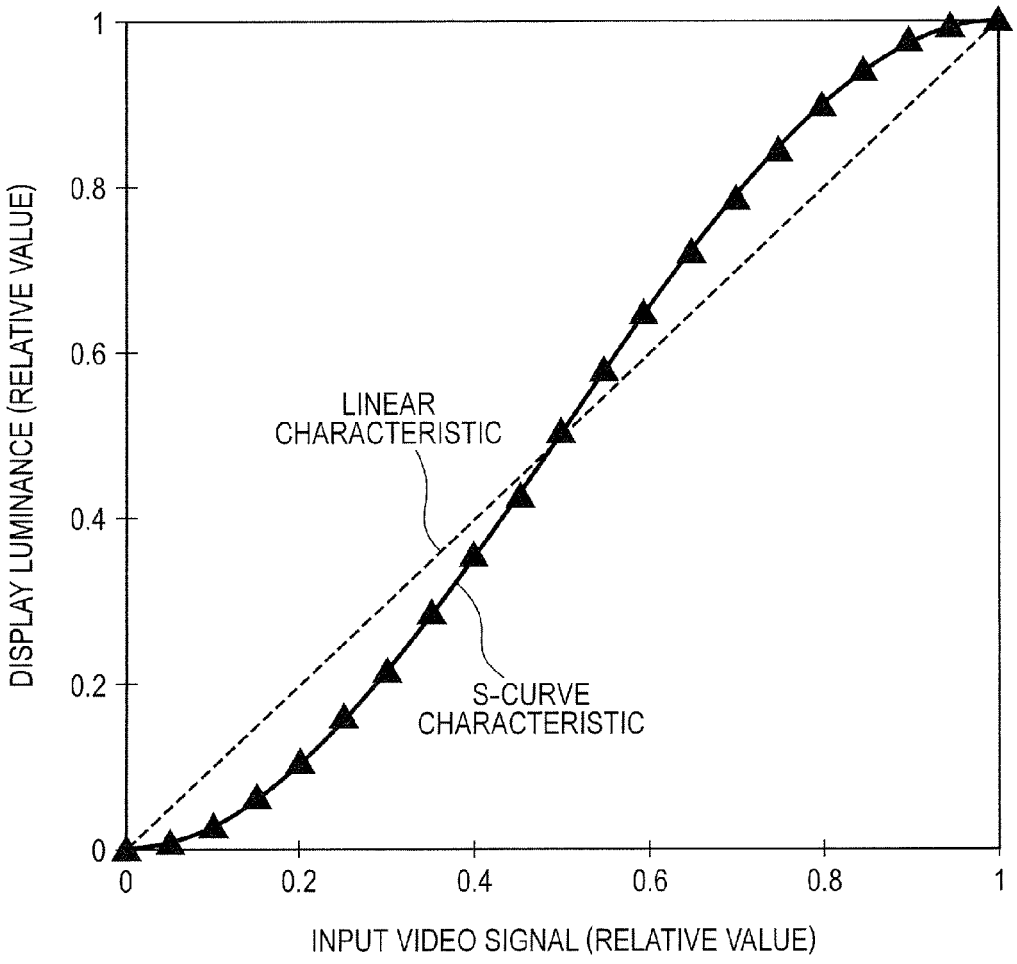
FIG. 5 is an explanatory drawing illustrating a gamma characteristic with an S curve.

FIG. 5 is an explanatory drawing illustrating a gamma characteristic with an S curve. As is the case with FIG. 4, the horizontal axis shows the video signal inputted and the vertical axis shows the luminance displayed, both in relative values. The linear characteristic is shown by a dashed line. The S-curve characteristic has a point of inflection. FIG. 5 illustrates the S-curve characteristic which has the point of inflection at a point where the input video signal=the display luminance=0.5. The inputted video signal having a comparatively dark pixel of 0-0.5 is compensated to the darker direction, and the inputted video signal having a comparatively bright pixel of 0.5-1 is compensated to the brighter direction. For example, when the range of the inputted video signal is 0.2-0.8, the range of the display luminance is extended to 0.1-0.9 by the S-curve characteristic. In this way, the effect that the contrast is enhanced is obtained and the visibility-wise luminance which human feels is also enhanced.

By imparting the gamma control characteristics which realize the small gamma characteristic and the S-curve characteristic, to the fixed gamma correction unit 18 of the image processing device of the comparative example 2, it becomes possible to enhance the visibility-wise luminance while performing the backlight control. However, it turned out that there is a case where the image quality is degraded by the above-described gamma correction, depending on a picture pattern of the video signal inputted. For example, while performing the gamma correction aiming at the small gamma characteristic, when a picture shifted toward the high-luminance side (a bright picture on the whole) is inputted, the contrast is decreased. While performing the gamma correction aiming at the S-curve characteristic, when a picture shifted toward the low-luminance side (a dark picture on the whole) is inputted, the picture is compensated still more darkly and the contrast is decreased also.

<Pattern-Adaptive Gamma Correction>

FIG. 1 is a block diagram illustrating an example of a configuration of an image processing device 100 according to Embodiment 1.

As is the case with the comparative examples 1 and 2, a video signal is inputted into the image processing device 100 according to Embodiment 1. The image processing device calculates a video output signal to be supplied to the coupled display panel 90, such as a liquid crystal, and a backlight control signal to be supplied to the backlight controller 91 attached to the display panel 90. As is the case with the comparative examples 1 and 2, the image processing device 100 includes a peak value detector 3, a peak ACL control gain calculation unit 4, a luminance modulator 1, a backlight control gain calculation unit 10, and a gain converter 11. The image processing device 100 according to Embodiment 1 further includes a histogram detector 2, a histogram modulator 6, a luminance distribution rate calculation unit 7, a pattern-adaptive gamma calculation unit 8, a luminance modulation gain calculation unit 9, and a total control gain calculation unit 5.

The histogram detector 2 calculates frequency distribution about the luminance value of the video signal inputted. It is preferable to target the display region which is the same as the target region of the backlight control. When the backlight control targets the whole surface of the display panel 90 in block, the image processing including the histogram detection is performed in units of pictures (frames). On the other hand, when performing the local dimming with the backlight control for every divided region, the image processing including the histogram detection is also performed in the corresponding picture area.

By performing the local dimming and performing the image processing including the histogram detection also in the same region, the power consumption of the backlight can be controlled more finely. Therefore, it is possible to enhance the reduction effect of the power consumption. In the present image processing, it is necessary to perform additional processing for preventing a streak-shaped level difference of the luminance from arising on the boundary of the region. However, to cope with the case, the publicly known technology adopted in the local dimming technology can be utilized. For easier comprehension, hereinafter, the explanation is made assuming that the unit of the image processing is one picture (one frame).

The peak value detector 3 detects the highest luminance (brightest luminance) among the picture levels (luminance) of the pixels of one picture (one frame) (a picture area corresponding to the target region of the backlight control in the case of the local dimming). The peak value detector 3 illustrated in the comparative examples 1 and 2 of FIG. 2 and FIG. 3 detects directly the peak value from the video signal inputted. The direct detection method of a peak value in this way may involve an issue that the detection stability deteriorates extremely when only several pixels exhibit a spiky high level as uniquely observed in a highly noisy picture. On the other hand, the peak value detector 3 according to Embodiment 1 detects the peak value from the histogram (frequency distribution) of the luminance extracted by the histogram detector 2. For example, assuming that the total pixel number in one picture (one frame) is 100%, the frequency (pixel number) is accumulated sequentially from the one having the lowest luminance. A luminance value when the accumulated value of the histogram reaches 98% is detected as the peak value. According to this procedure, when only several pixels exhibit a high luminance due to noises, the luminance concerned is not detected as the peak value; accordingly, it is possible to enhance the detection stability.

The peak ACL control gain calculation unit 4 calculates a peak ACL control gain which is the gain processing according to the detected peak value, and supplies it to the luminance modulator 1. On the other hand, the backlight control gain calculation unit 10 makes the gain converter 11 execute the gain processing according to the peak value detected by the peak value detector 3. According to this configuration, the fundamental operation becomes same as the peak ACL control in the comparative example 1.

With the gain obtained by the peak ACL control gain calculation unit 4, the histogram modulator 6 performs modulation processing to the histogram outputted from the histogram detector 2, that is, a histogram detection value (frequency) for every picture levels (luminance) obtained from the inputted video signal. Practically, the gain modulation to the picture level is performed. The modulation processing by the peak ACL control gain to a histogram is the processing in which the histogram detection value in each picture level is read as the histogram detection value in the picture level multiplied by the peak ACL control gain. For example, when a video signal is comprised of 8 bits, the picture level has 256 gradations and the gain processing is performed to the picture level. When the peak detection value is 50%, no histogram will exist in picture levels equal to or greater than 128 which expresses 50% of luminance; accordingly, the peak ACL control gain will become twice. Then, in the processing, the histogram existing in the picture level 128 is read as the histogram existing in the picture level 256 (in the actual processing, 255 as the maximum value of 8 bits) after the gain processing of 128×2 is performed. Here, the explanation has been made assuming that the gradation number of the histogram is 256, same as the video signal. However, the similar processing can be performed when the gradation number of the histogram is 16 or 64 which are generally adopted.

Figure 6:
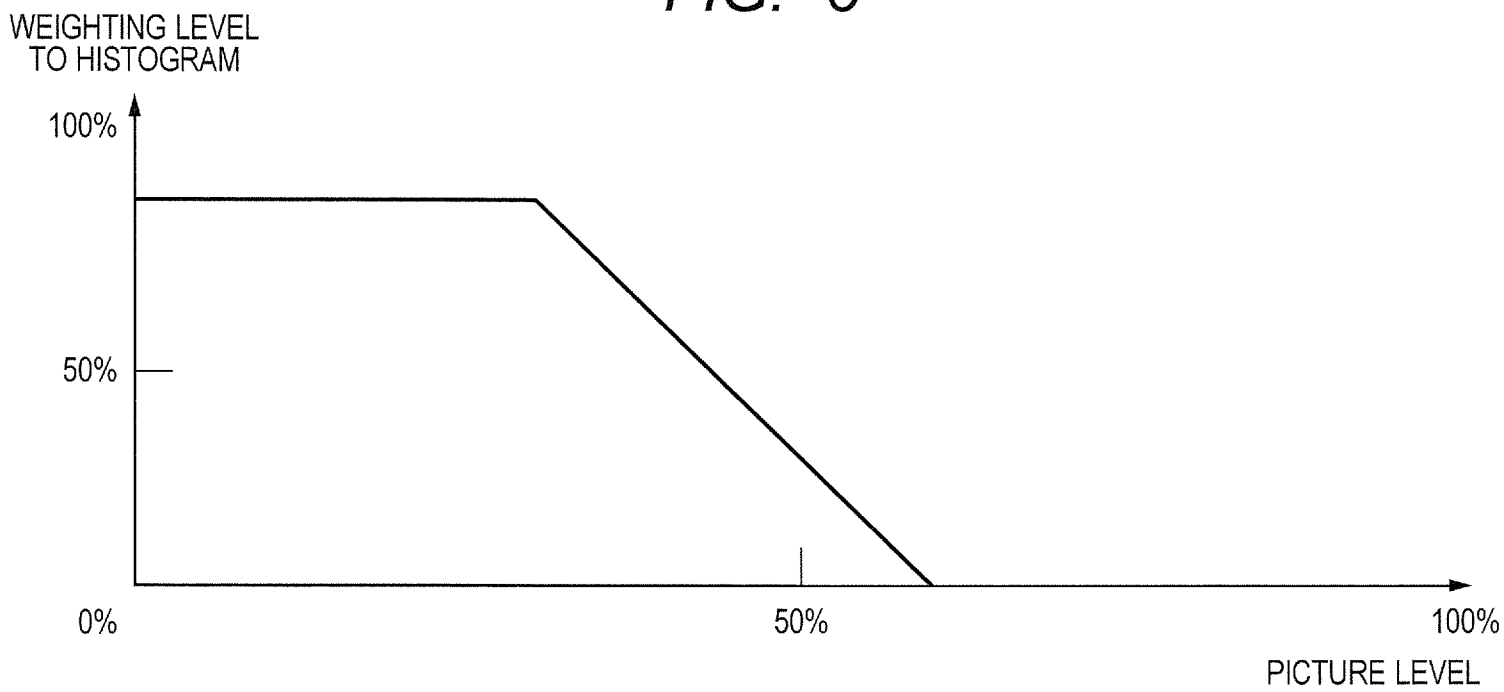
FIG. 6 is an explanatory drawing illustrating pretreatment for calculating a luminance distribution rate in a low/middle picture level.
Figure 7:
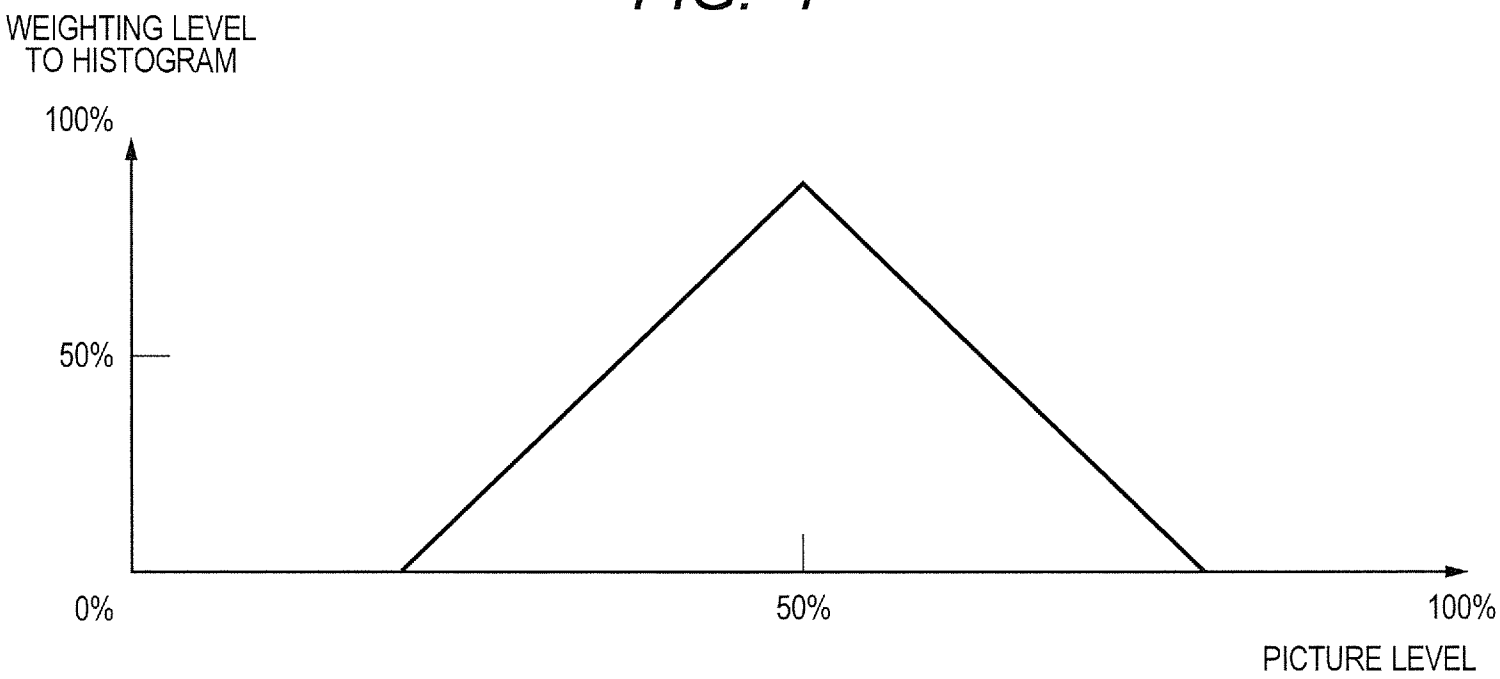
FIG. 7 is an explanatory drawing illustrating pretreatment for calculating a luminance distribution rate in a middle picture level.

The luminance distribution rate calculation unit 7 analyzes the distribution state of a histogram to which the modulation processing has been performed with the peak ACL control gain. The distribution state of the histogram includes a distribution which is localized (concentrated) to a part of the picture level region, a distribution which is localized (concentrated) to several parts of the picture level region, and a comparatively uniform distribution without remarkable localization, for example. The luminance distribution rate calculation unit 7 performs the pretreatment of weighting for every picture level to the histogram inputted, accumulates the histogram detection values after the weighting, and calculates a distribution rate from the accumulated value. As an example, the weighting from a low picture level to a middle picture level is performed as illustrated in FIG. 6 to the histogram detection values, and the histogram detection values after the weighting are accumulated. From the accumulated value, it is possible to compute the distribution rate of the low/middle picture level. As another example, the weighting near a middle picture level is performed as illustrated in FIG. 7, and the histogram detection values after the weighting are accumulated. From the accumulated value, the distribution rate near the middle picture level is calculated. Of course, the method of calculating the distribution rate of the low/middle picture level and the distribution rate near the middle picture level is not restricted to the above.

The pattern-adaptive gamma characteristic calculation unit 8 calculates a suitable gamma characteristic automatically, according to the calculated picture level distribution rate. Detailed operation is described later.

The luminance modulation gain calculation unit 9 calculates the luminance modulation gain according to the gamma characteristic given by the pattern-adaptive gamma characteristic calculation unit 8. The luminance modulation gain is given as a function which associates the value of the picture level after the modulation with each picture level (luminance) of the video signal inputted.

The total control gain calculation unit 5 calculates a total gain value in advance, by multiplying two modulation gain values obtained from two steps of processing by the peak ACL control gain calculation unit 4 and the luminance modulation gain calculation unit 9. The luminance modulator 1 performs the luminance modulation with the use of this total gain value. The luminance modulation refers to the processing which converts the picture level (luminance) in every pixel of the video signal inputted into another picture level according to the value of the picture level. The luminance modulator 1 is configured, for example with a one-dimensional look-up table (1D-LUT: Look-Up Table). When a video signal is expressed by 8 bits and 256 gradations, the look-up table can be configured by a memory of 256 words×8 bits. In place of the implementation by a look-up table (1D-LUT), it is possible to adopt the implementation by hardware which has been converted into a function in advance, or by software.

Operation of the pattern-adaptive gamma characteristic calculation unit 8 is explained in more detail.

For example, when the distribution state of a histogram is comparatively uniform without a remarkable localized distribution, the gamma correction by a small gamma value characteristic is suitable. As explained with reference to FIG. 4, the small gamma value characteristic is a convex curve as compared with the linear characteristic, and the display luminance takes always a larger value to the video signal inputted. Therefore, it is possible to enhance the visibility-wise luminance on the whole. When a low/middle picture level distribution rate is high as a result of the analysis by the luminance distribution rate calculation unit 7, the small gamma value characteristic is more effective.

For example, when the distribution state of a histogram is localized to one place, the S-curve correction with the point of inflection at the barycenter of the localized distribution is suitable. As explained with reference to FIG. 5, the S-curve correction further enhances a picture level at higher luminance from the point of inflection, and further reduces a picture level at lower luminance from the point of inflection. Accordingly, the contrast enhancement of the picture is realized. As for a picture with a histogram which is locally distributed only to the high luminance side or the low luminance side from the point of inflection, there is an issue that the contrast is rather decreased, as described above. However, this issue is solved by matching the barycenter of the localized distribution with the point of inflection.

Figure 8:
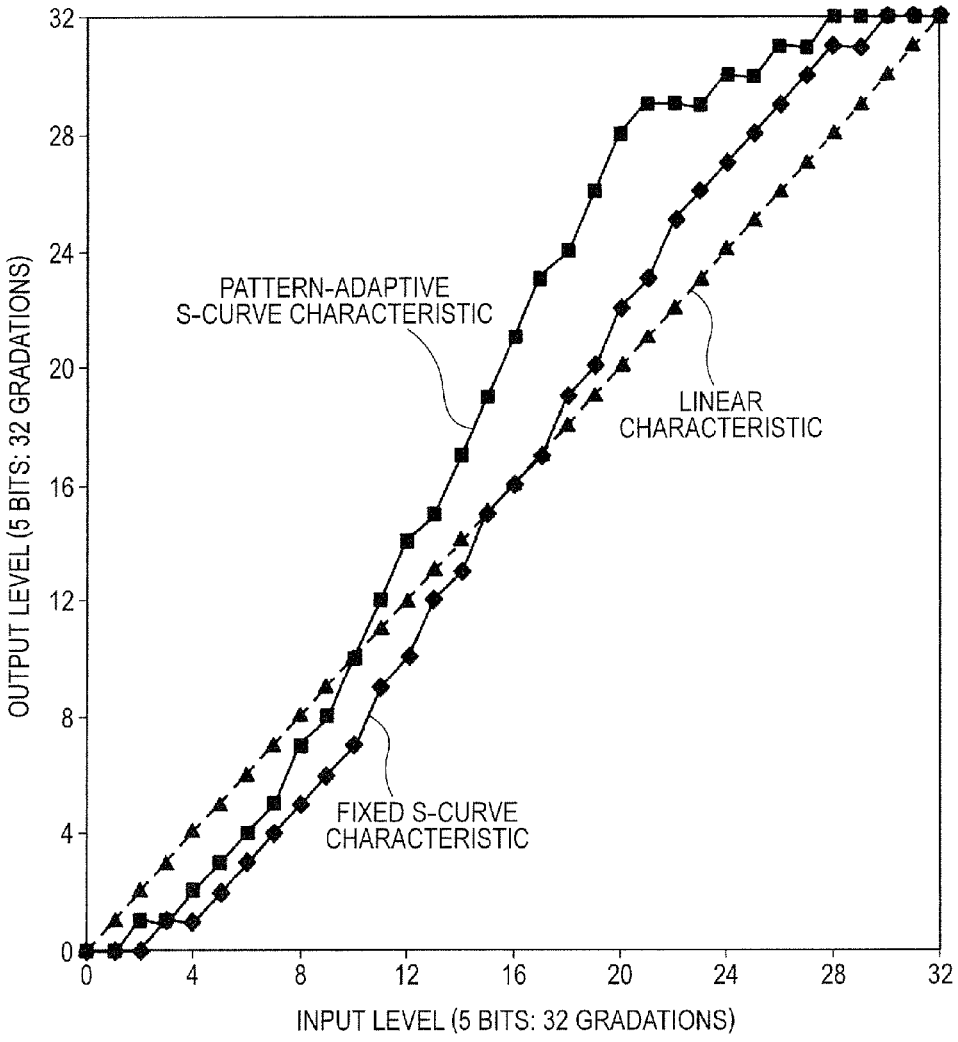
FIG. 8 is an explanatory drawing illustrating a gamma characteristic with a pattern-adaptive S curve.

FIG. 8 illustrates a fixed S-curve characteristic and a picture pattern-adaptive S-curve characteristic. The horizontal axis shows the input picture level and the vertical axis shows the output picture level, both in 32 gradations (5 bits). A dashed line is the linear characteristic. The fixed S-curve characteristic has the point of inflection at a middle point of the picture level=16. On the other hand, the pattern-adaptive S-curve characteristic has the point of inflection at the picture level=10. The pattern-adaptive S-curve characteristic is applied to a picture with a histogram which has a barycenter at the picture level=10, for example, a picture having a picture pattern of which the histogram is locally distributed at the picture levels 4-16.

Figure 9:
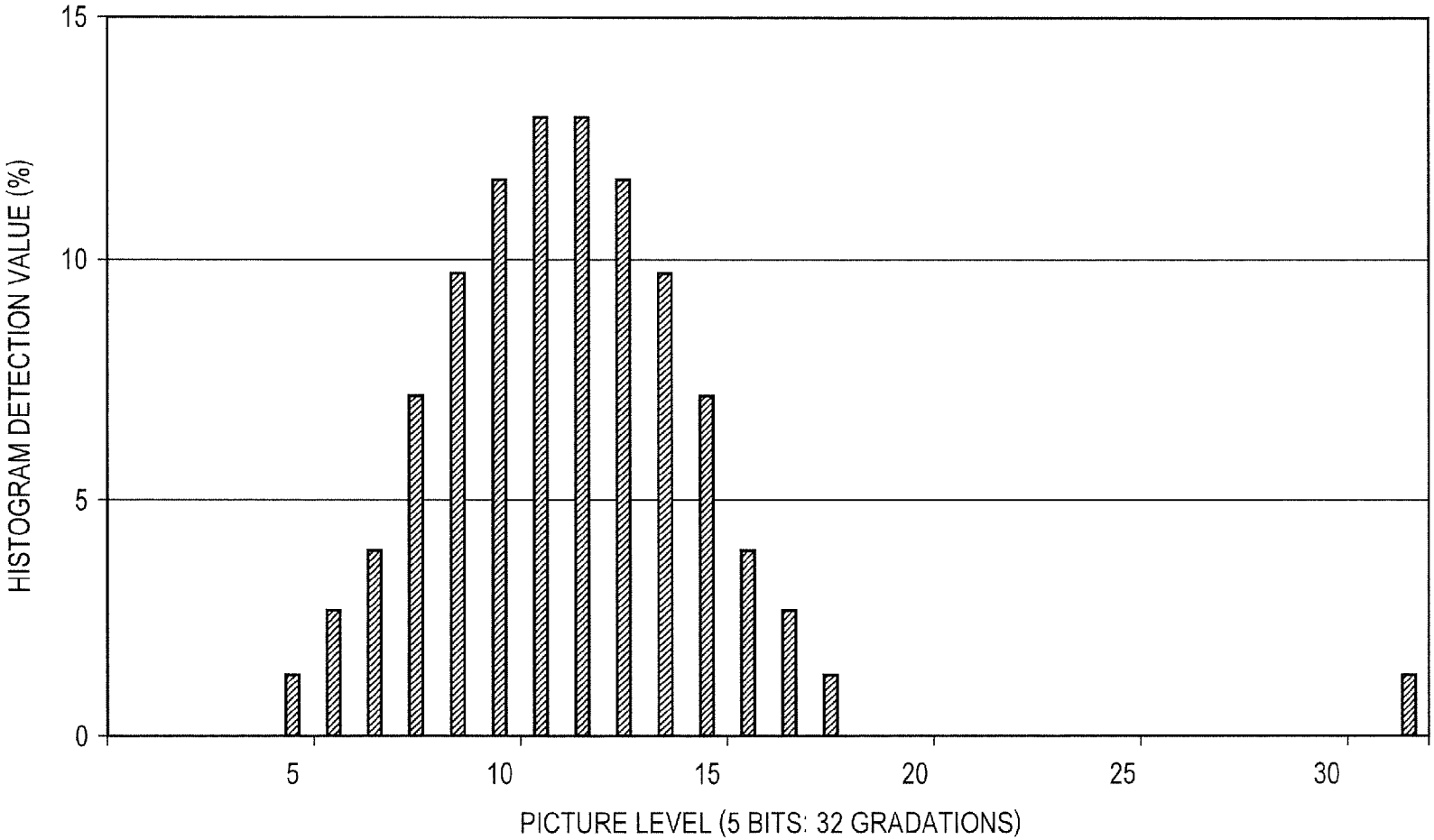
FIG. 9 is a drawing illustrating a histogram of a picture level before luminance modulation processing.
Figure 10:
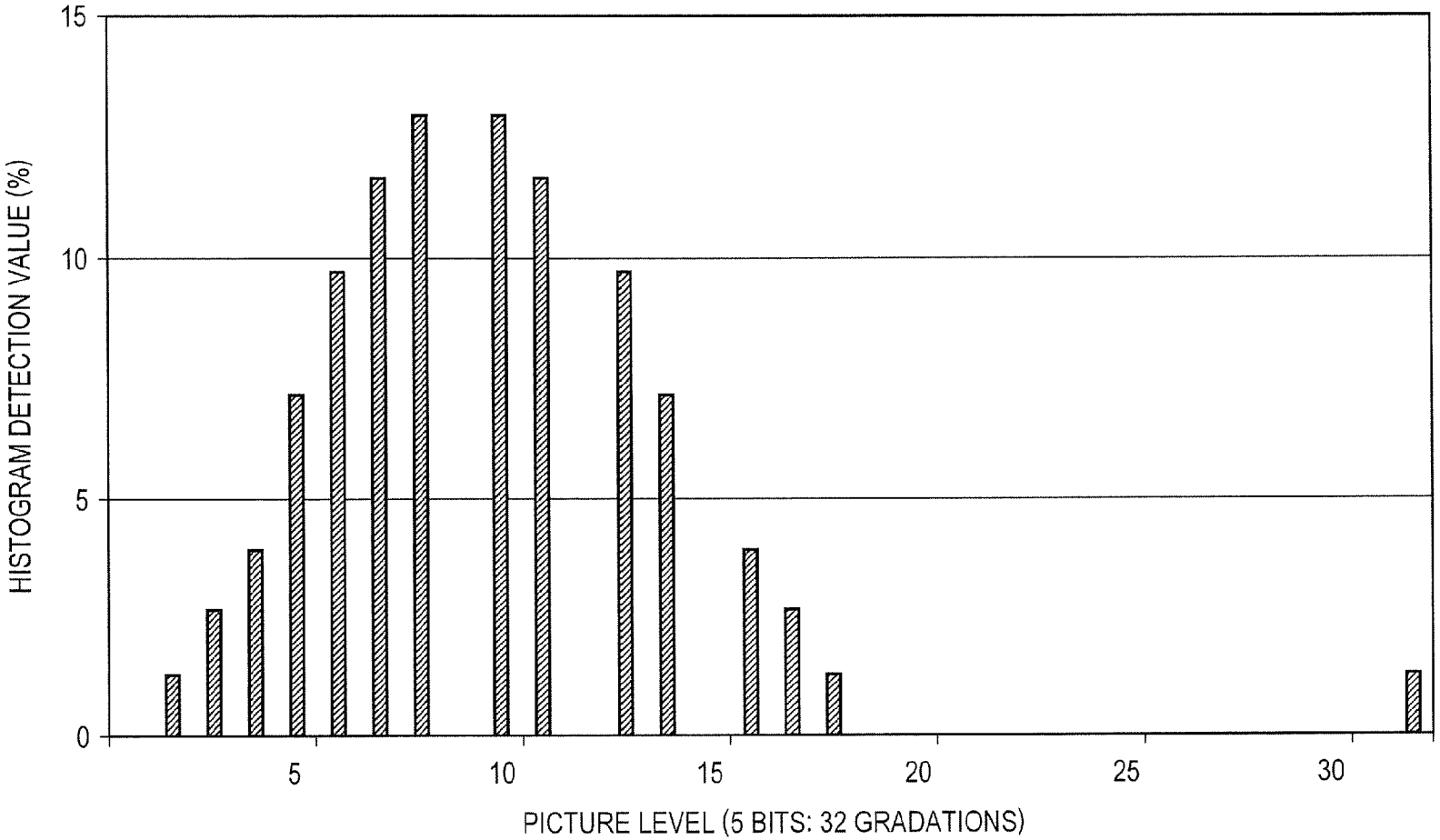
FIG. 10 a drawing illustrating a histogram of a picture level after the luminance modulation processing with a fixed gamma.
Figure 11:
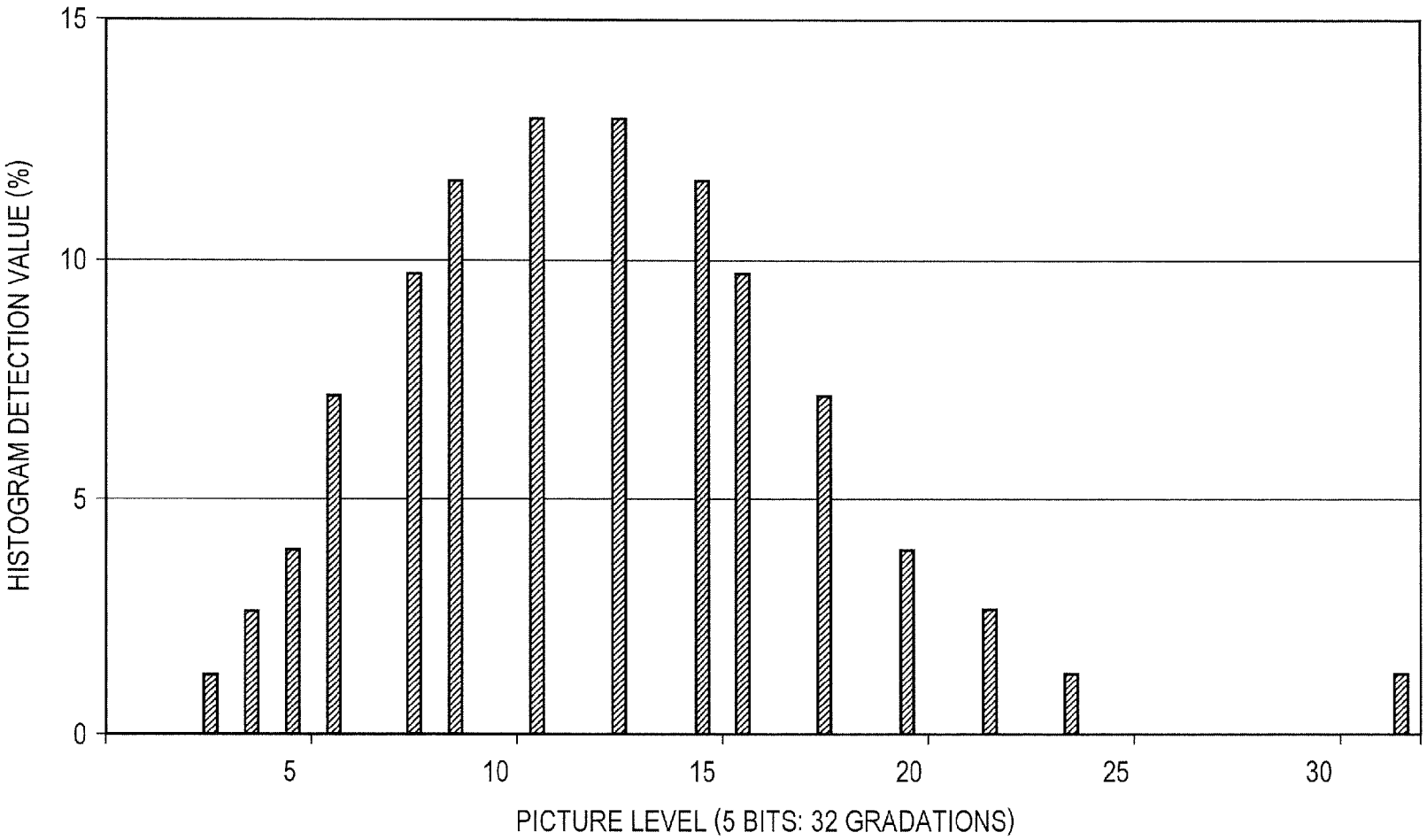
FIG. 11 is a drawing illustrating a histogram of a picture level before the luminance modulation processing.

The histogram distribution state is explained in more detail. FIGS. 9, 10, and 11 illustrate respectively a histogram before the luminance modulation is performed, a histogram to which the luminance modulation is performed by the fixed gamma (fixed S-curve), and a histogram to which the luminance modulation is performed by the pattern-adaptive gamma (pattern-adaptive S-curve). The horizontal axis shows a picture level (luminance) in 32 gradations (5 bits), and the vertical axis shows a histogram detection value (frequency) in percent (%). For simplicity, the explanation assumes that the video signal is expressed by 32 gradations (5-bit accuracy). Therefore, it seems that there is no continuity in the gamma characteristic and the gradation characteristic is low. Practically, however, if the processing is performed at 8 bits (256 gradations), there is no issue of the gradation characteristic.

As illustrated in FIG. 9, it is assumed that the histogram before the luminance modulation is performed is locally distributed to the picture levels 5-18. As described above, the histogram modulator 6 has performed the modulation processing with the gain obtained by the peak ACL control gain calculation unit 4. Accordingly, the peak value is 32 of the maximum luminance. The histogram distribution state illustrated in FIG. 10 after the luminance modulation is performed by the fixed gamma (fixed S-curve), the localized distribution of the picture level is modulated to the picture levels 2-18. The picture level of a pixel of the picture level=5 originally is modulated to 2 and the picture level of a pixel of the picture level=6 originally is modulated to 3. On the other hand, the picture level of a pixel of the picture level=18 originally on the high luminance side is modulated to 18 as it is. In the fixed S-curve, the point of inflection is at the picture level=16 as described above. Accordingly, the picture level of a pixel of the picture level=18 originally near the point of inflection does not change, remaining at 18. Since the luminance distribution range is expanded as compared with the histogram distribution state before the luminance modulation of FIG. 9, there is a contrast enhancement effect. However, there is no shift to the direction of a high picture level; accordingly, there is no luminance enhancement effect.

As compared with this, as for the histogram distribution state illustrated in FIG. 11 to which the luminance modulation is performed by the pattern-adaptive gamma (pattern-adaptive S-curve), the localized distribution of the picture level is modulated to the picture levels 3-24. The picture level of a pixel of the picture level=5 originally is modulated to 3 and the picture level of a pixel of the picture level=6 originally is modulated to 4. On the other hand, the picture level of a pixel of the high picture level=18 originally is modulated to 24. In the pattern-adaptive S-curve, the point of inflection is at the picture level=11-12 which is the barycenter of the localized distribution on the histogram. Accordingly, centering on this point, the picture level at the low luminance side is modulated to the lower direction, and the picture level at the high luminance side is modulated to the higher direction. As compared with the histogram distribution state before the luminance modulation of FIG. 9, in the histogram distribution state illustrated in FIG. 11 to which the luminance modulation is performed by the pattern-adaptive gamma (pattern-adaptive S-curve), the luminance distribution range is fully expanded and is fully shifted also to the direction of the high picture level. Therefore, the luminance enhancement effect as well as the contrast enhancement effect is sufficient.

In the histograms after the luminance modulation processing illustrated in FIG. 10 and FIG. 11, there exist picture levels for which the histogram detection value has been calculated to be 0 by the processing. For example, they are the picture levels=9, 12, and 15 in FIG. 10, and the picture levels=7, 10, 12, 14, 17, 19, 21, and 23 in FIG. 11. Even if there exists the picture level having zero histogram detection value in this way, no special degradation on the picture is produced. However, it is also possible to recover the continuity of the picture level by adding filtering as an example. Accordingly, in addition to the contrast enhancement, the effect of the enhancement of resolution is also produced.

The difference of these two luminance modulation results arises from the following difference. That is: while the luminance modulation by the fixed gamma sets always the point of inflection of the S-curve at the level 16 as the intermediate level, the luminance modulation by the pattern-adaptive gamma detects the barycenter of the distribution in the histogram distribution state before the luminance modulation as illustrated in FIG. 9, and sets the barycenter detection result of 11-12 as the point of inflection of the S-curve, thereby the setting optimized to the picture pattern is created. The S-curve gamma characteristic has a small output video level to an input video level in a small picture level region, and a large output video level to an input video level in a large picture level region. The point of inflection of the S-curve refers to the point where the magnitude relation of this input-output video level reverses (coincides). In the above-described example, the barycenter itself of the histogram is set as the point of inflection of the S-curve.

However, when the luminance enhancement effect is considered as important, to set the point of inflection at the picture level which is a little lower than the barycenter increases the shift amount to the direction of the higher picture level, resulting in an effective setup.

Figure 12:
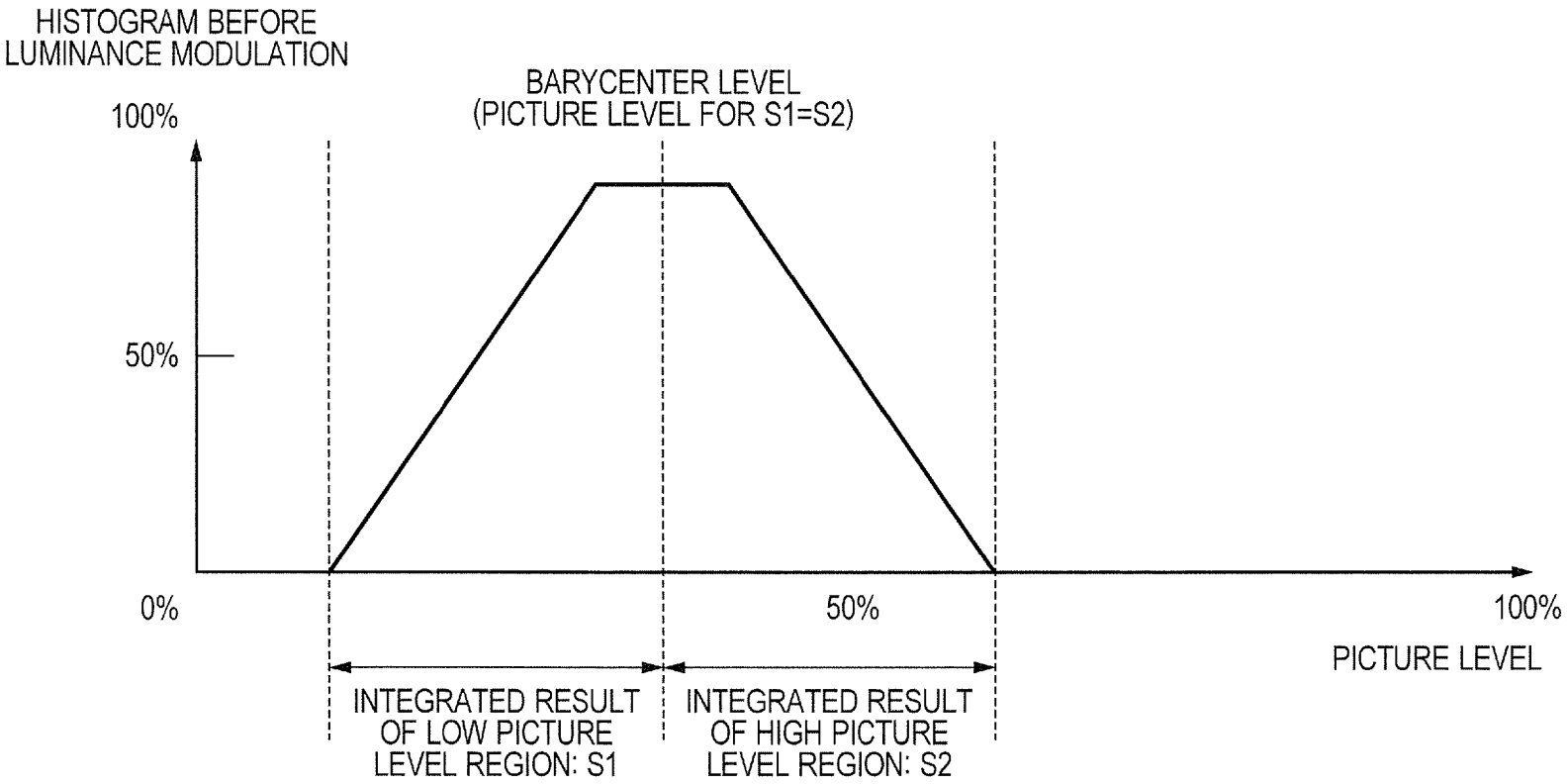
FIG. 12 is an explanatory drawing illustrating a detecting method of a barycenter point in a histogram.

As a method of detecting the barycenter of a histogram distribution, it is possible to use an APL generally called the average luminance level. Alternatively, as illustrated in FIG. 12, the frequency distribution of a histogram is integrated to calculate an area and to detect a picture level at a boundary at which an area of the low picture level side is equal to an area of the high picture level side. This picture level at the boundary gives the barycenter of the histogram distribution.

In this way, in the range extension processing by the S-curve gamma characteristic, in order to obtain most effectively the contrast enhancement effect and the luminance enhancement effect, it is necessary to match the picture level region where the histogram distribution concentrates most with the picture level region extended by the gamma correction; therefore it is necessary to adopt the luminance modulation processing which is adapted for the picture pattern.

Also in the case of the small gamma value characteristic, it is possible to adopt a similar pattern adaptation processing by changing a gamma value according to the barycenter of the histogram.

In the above, the small gamma value correction and the S-curve correction are illustrated as a pattern-adaptive gamma processing which aims at obtaining the luminance enhancement effect for the backlight control. However, it is also preferable to adopt a histogram equalization (smoothing) method. This method is a correction process in which the histogram accumulation result is employed as a gamma characteristic, and in which the histogram distribution state after the luminance modulation is aimed to be distributed uniformly from a low picture level to a high picture level. Since the dynamic range of the picture level can be effectively utilized, the contrast enhancement effect and the luminance enhancement effect can be obtained. For example, when the distribution state of a histogram is locally distributed in several parts, it is possible to modulate the picture level from a concentrating part of the histogram detection value to a sparse part; accordingly, it is possible to enhance the contrast in each locally distributed part.

As described above, there are two points as follows in the effect of calculating automatically the gamma characteristic adaptive to the picture pattern and of performing the luminance modulation.

The first point is: when an originally high-contrast and bright picture is inputted, if the luminance modulation processing by the fixed gamma characteristic is performed, there arises a unfavorable possibility that the saturation in a high picture level region (whitening) and the saturation in a low picture level region (blackening) take place. However, such unfavorable possibility can be avoided in the pattern adaptation processing.

The second point is: according to the picture pattern characteristic (the center of a distribution of the picture level=the concentrated luminance level), it is possible to achieve the contrast enhancement effect and the luminance enhancement effect most effectively.

<Image Processing Method>

The image processing device 100 according to Embodiment 1 illustrated in FIG. 1 may be implemented by hardware or may be implemented by middleware in which a part of the image processing method mounted is implemented by software.

Figure 13:
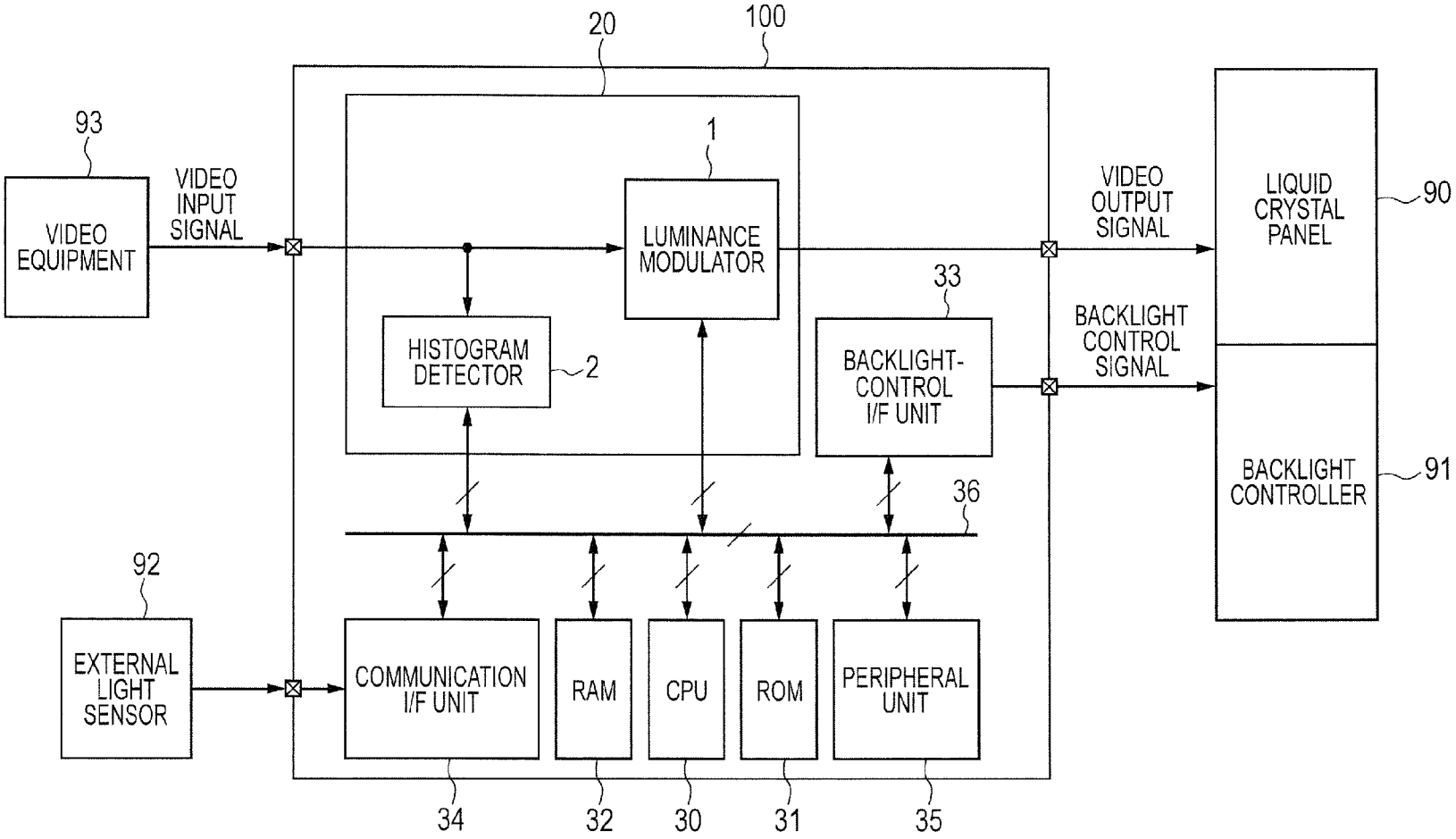
FIG. 13 is a block diagram illustrating an example of a configuration of the image processing device in an SOC.

FIG. 13 is a block diagram illustrating an example of a configuration of an image processing device 100 according to Embodiment 1 in an SOC (System On a Chip). To the image processing device 100, a display panel 90 such as a liquid crystal to which a backlight controller 91 is attached and video equipment 93 which supplies a video signal are coupled. In addition, an external light sensor 92 may be coupled. The video equipment 93 includes a camera, an image content media player such as a blue-ray disk player and a DVD player, and a digital television receiver (DTV: Digital Television), for example. The image processing device 100 includes a video display unit 20, a CPU 30, a ROM (Read Only Memory) 31, a RAM (Random Access Memory) 32, a backlight control interface (I/F) unit 33, a communication interface (I/F) unit 35, and other peripheral units 35. They are coupled mutually via a bus 36. The video display unit 20 receives a video signal inputted from the video equipment 93, supplies it to a luminance modulator 1 and a histogram detector 2, respectively, and outputs a video output signal outputted from the luminance modulator 1 to the liquid crystal panel 90. The backlight control interface (I/F) unit outputs a backlight control signal to the backlight controller 91 of the coupled display panel 90. When the external light sensor 92 is employed, it is coupled to the communication interface (I/F) unit 35, such as I2C (Inter-Integrated Circuit) for example. The luminance modulator 1, the histogram detector 2, the backlight control interface (I/F) unit 33, and the communication interface (I/F) unit 35 are accessible from the CPU 30 via the bus 36, respectively. The peak value detector 3, the peak ACL control gain calculation unit 4, the histogram modulator 6, the luminance distribution rate calculation unit 7, the pattern-adaptive gamma calculation unit 8, the luminance modulation gain calculation unit 9, and the total control gain calculation unit 5 are implemented by software stored in the ROM 31. The total control gain calculated by the total control gain calculation unit 5 is set at the luminance modulator 1 via the bus 36. The backlight control gain calculation unit 10 and the gain converter 11 are similarly implemented by the software stored in the ROM 31. The backlight control gain calculated by the gain converter 11 is outputted as a backlight control signal via the backlight control interface (I/F) unit 33.

The configuration illustrated in FIG. 13 is only an example, and the configuration can be changed variously. For example, a part of the hardware included in the video display unit 20 may be changed so as to be implemented by software. Conversely, other functions may be implemented by hardware and may be included in the video display unit 20. The CPU 30 may be a processor of any kind of the single architecture or it may be a multiple-processor unit including plural processors. The CPU 30 or the processor and the multiple-processor unit which replace the CPU 30 may be provided with a cache memory or a local memory. The bus 36 may be hierarchized. The ROM 31 may be an electrically rewritable nonvolatile memory such as a flash memory, or it may be comprised of an SOC which does not mount a nonvolatile memory and may load software in a power-up sequence. The configuration illustrated in FIG. 13 is not restricted to the case where the image processing method illustrated in Embodiment 1 is implemented, and it is possible to apply the configuration also to an image processing device which implements the image processing method according to Embodiments 2-4 and other embodiments.

Figure 14:
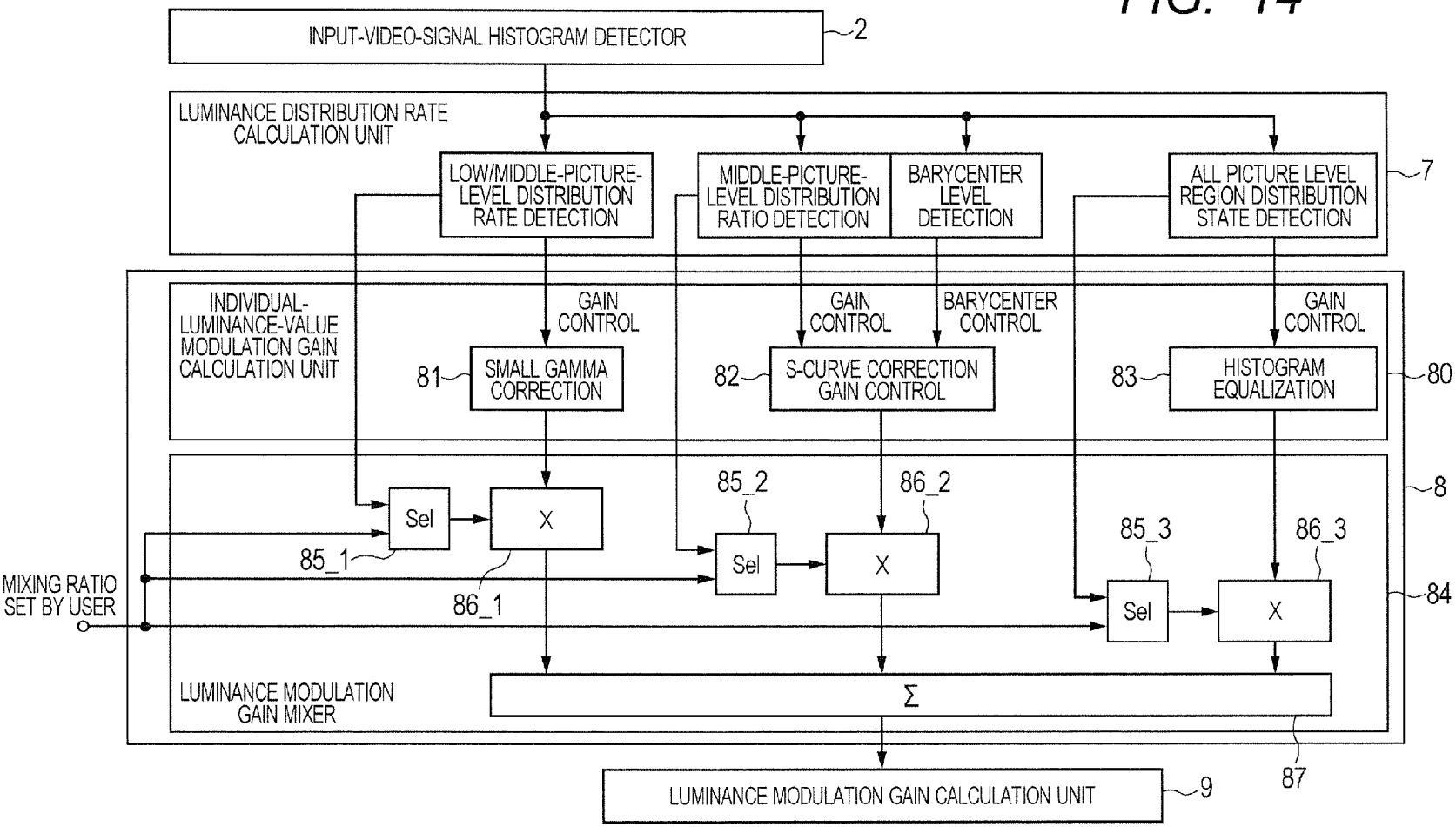
FIG. 14 is a process flow chart illustrating an example of operation of the image processing device.

FIG. 14 is a process flow chart illustrating an example of operation of the image processing device 100. In particular, the luminance distribution rate calculation unit 7 and the pattern-adaptive gamma calculation unit 8 are illustrated in detail. The histogram detected by the histogram detector 2 is supplied to the luminance distribution rate calculation unit 7, and the frequency distribution state is analyzed. The result is supplied to the individual-luminance-value modulation gain calculation unit 80 which composes the pattern-adaptive gamma calculation unit 8. The individual-luminance-value modulation gain calculation unit 80 includes a small gamma correction function calculation unit 81, an S-curve-correction-gain control function calculation unit 82, and a histogram equalizing (smoothing) function calculation unit 83.

The small gamma correction function calculation unit 81 performs the gamma correction according to the low/middle-picture-level distribution rate in the luminance distribution rate calculation unit 7. The adjustment is performed between the linear characteristic and the small gamma value characteristic illustrated in FIG. 4. When the low/middle-picture-level distribution rate is large, the gamma correction is brought close to the small gamma value characteristic, with the aim of the luminance enhancement by shifting the distribution to a high picture level. When the low/middle-picture-level distribution rate is small, the gamma correction is brought close to the linear characteristic. This is because that, when the low/middle-picture-level distribution rate is small, only the peak ACL control has already produced much distribution near the high picture level, therefore, there is a possibility for the saturation (whitening) to occur in the vicinity of the high picture level when the small gamma value is adapted. By adopting such a processing method, it is possible to avoid the possibility of the occurrence of the saturation.

The S-curve-correction-gain control function calculation unit 82 undergoes the gain control according to the middle-picture-level distribution rate in the luminance distribution rate calculation unit 7, and also undergoes the barycenter control according to the barycenter level detection. The adjustment is performed between the linear characteristic and the S-curve characteristic illustrated in FIG. 5. When the distribution rate near the middle picture level is large, the gamma correction is brought close to the S-curve characteristic, with the aim of the luminance enhancement and the contrast enhancement by shifting the distribution to the low picture level and the high picture level. On the other hand, when the distribution rate near the middle picture level is small, the gamma correction is brought close to the linear characteristic. This is because that, when the distribution rate near the middle picture level is small, only the peak ACL control has already produced much distribution near the low picture level, therefore, there is a possibility both for the saturation (blackening) to take place in the vicinity of the low picture level and for the saturation (whitening) to take place in the vicinity of the high picture level when the S-curve characteristic is adopted. By adopting such a processing method, it is possible to avoid the possibility of the occurrence of the saturation also in the S-curve correction.

The histogram equalizing (smoothing) function calculation unit 83 undergoes the gain control according to all the picture level regions in the luminance distribution rate calculation unit 7. The functions (gain control value) calculated by each of the calculation units 81-83 are supplied to the luminance modulation gain mixer 84 and added with weighting. The result is outputted to the luminance modulation gain calculation unit 9. The luminance modulation gain mixer 84 is comprised of weighting factor selectors 85_1-85_3, weighting multiplication units 86_1-86_3, and an adder 87. The weighting factor selectors 85_1-85_3 select one of the mixing ratio set up by a user or the mixing ratio based on the analysis result in the luminance distribution rate calculation unit 7, and supplies it to the weighting multiplication units 86_1-86_3. The outputs of the weighting multiplication units 86_1-86_3 are summed by the adder 87, normalized if needed, and outputted to the luminance modulation gain calculation unit 9.

The mixing ratio is set up by the user or is adjusted based on the analysis result in the luminance distribution rate calculation unit 7. In the case of being based on the analysis result of the luminance distribution rate calculation unit 7, when the low/middle-picture-level distribution rate is large for example, the mixing ratio of the function (gain control value) outputted from the small gamma correction function calculation unit 81 is increased. When the middle-picture-level distribution rate is large, the mixing ratio of the function (gain control value) outputted from the S-curve-correction-gain control function calculation unit 82 is increased. While the histogram distributes in all the picture level regions, the mixing ratio of the function (gain control value) outputted from the histogram equalizing (smoothing) function calculation unit 83 is increased.

As described above, it is possible to enhance the visibility adaptively according to the picture pattern of the video input signal, by performing the weighting addition process (mixing) based on the analysis result of the luminance distribution rate calculation unit 7.

Embodiment 2

Total Control Gain=Peak ACL Control Function×Luminance Modulation Function

Figure 15:
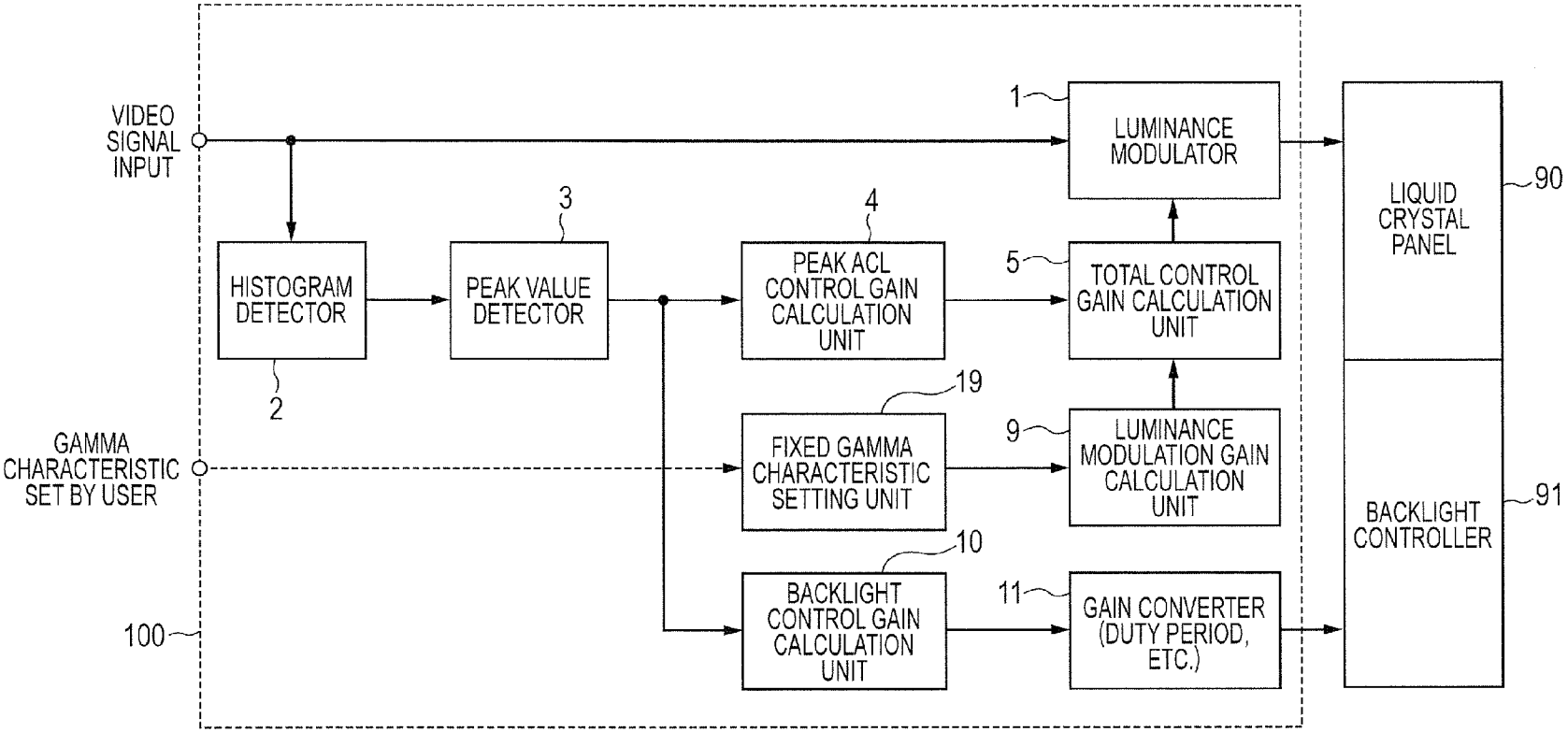
FIG. 15 is a block diagram illustrating an example of a configuration of an image processing device according to Embodiment 2.

FIG. 15 is a block diagram illustrating an example of a configuration of an image processing device according to Embodiment 2.

As is the case with the comparative example 2 illustrated in FIG. 3, a video signal is inputted into the image processing device 100 according to Embodiment 2. The image processing device calculates a video output signal to be supplied to a coupled display panel 90 such as a liquid crystal and a backlight control signal to be supplied to a backlight controller 91 attached to the display panel 90. As is the case with the comparative example 2, the image processing device 100 includes a peak value detector 3, a peak ACL control gain calculation unit 4, a luminance modulator 1, a backlight control gain calculation unit 10, and a gain converter 11. Compared with the comparative example 2 which includes the fixed gamma correction unit 18 in the subsequent stage of the luminance modulator 1, the image processing device 100 according to Embodiment 2 includes a histogram detector 2, a fixed gamma characteristic setting unit 19, a luminance modulation gain calculation unit 9, and a total control gain calculation unit 5.

The histogram detector 2 calculates frequency distribution about the luminance value of the video signal inputted. The peak value detector 3 detects the highest luminance (peak value) among the picture levels of the pixels composing one picture (one frame). The peak ACL control gain calculation unit 4 calculates a peak ACL control gain which is the gain processing according to the detected peak value, and supplies it to the luminance modulator 1. On the other hand, the backlight control gain calculation unit 10 makes the gain converter 11 execute the gain processing according to the peak value detected by the peak value detector 3. According to this configuration, the fundamental operation becomes same as the peak ACL control in the comparative example 1. It is also preferable to provide the peak value detector 3 as in the comparative example 2 and to omit the histogram detector 2.

A user-defined gamma characteristic is set to the fixed gamma characteristic setting unit 19. The luminance modulation gain calculation unit 9 calculates the luminance modulation gain according to the gamma characteristic concerned. The total control gain calculation unit 5 calculates a total gain value in advance, by multiplying two modulation gain values obtained from the processing by the peak ACL control gain calculation unit 4 and the processing by the luminance modulation gain calculation unit 9. The luminance modulator 1 performs the luminance modulation with the use of this total gain value.

Figure 16:
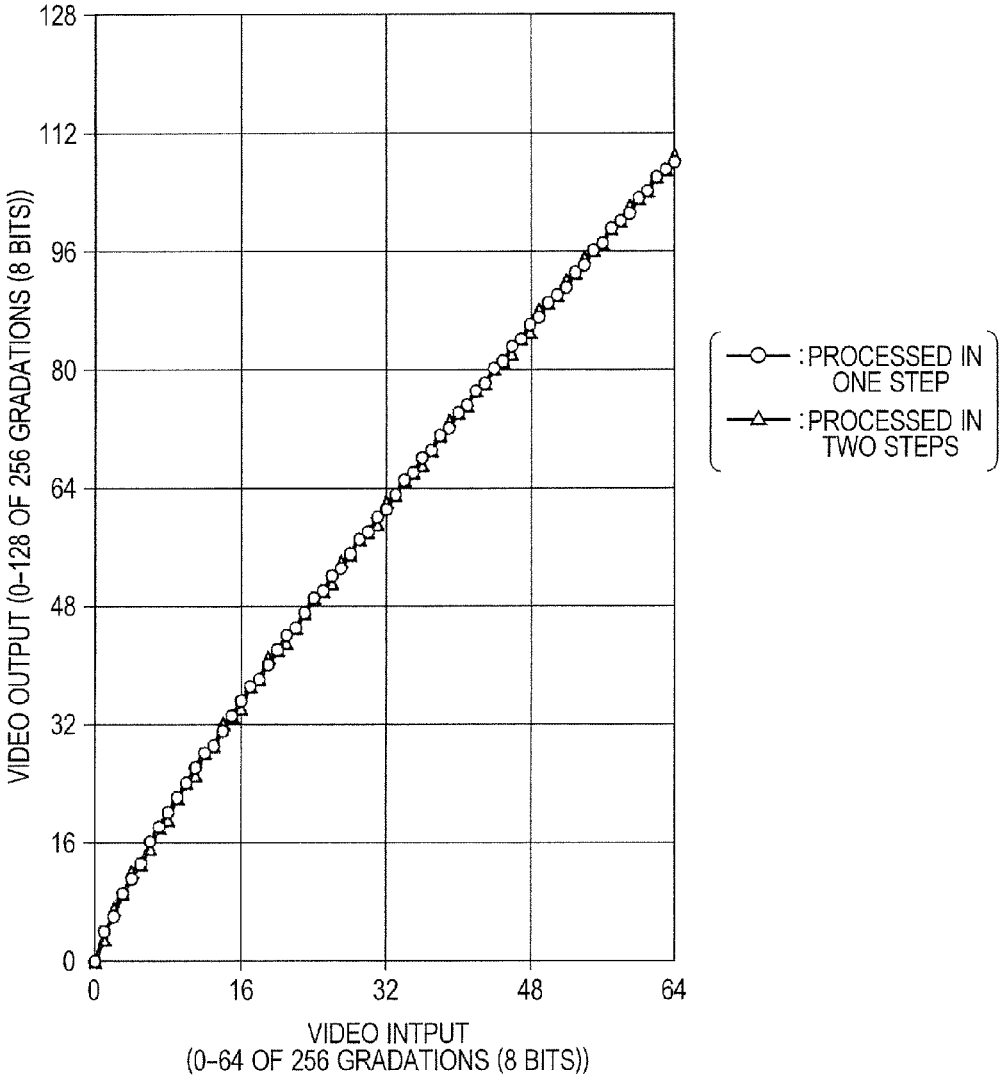
FIG. 16 is a graph illustrating an example of input-output characteristics of the image processing device.
Figure 17:
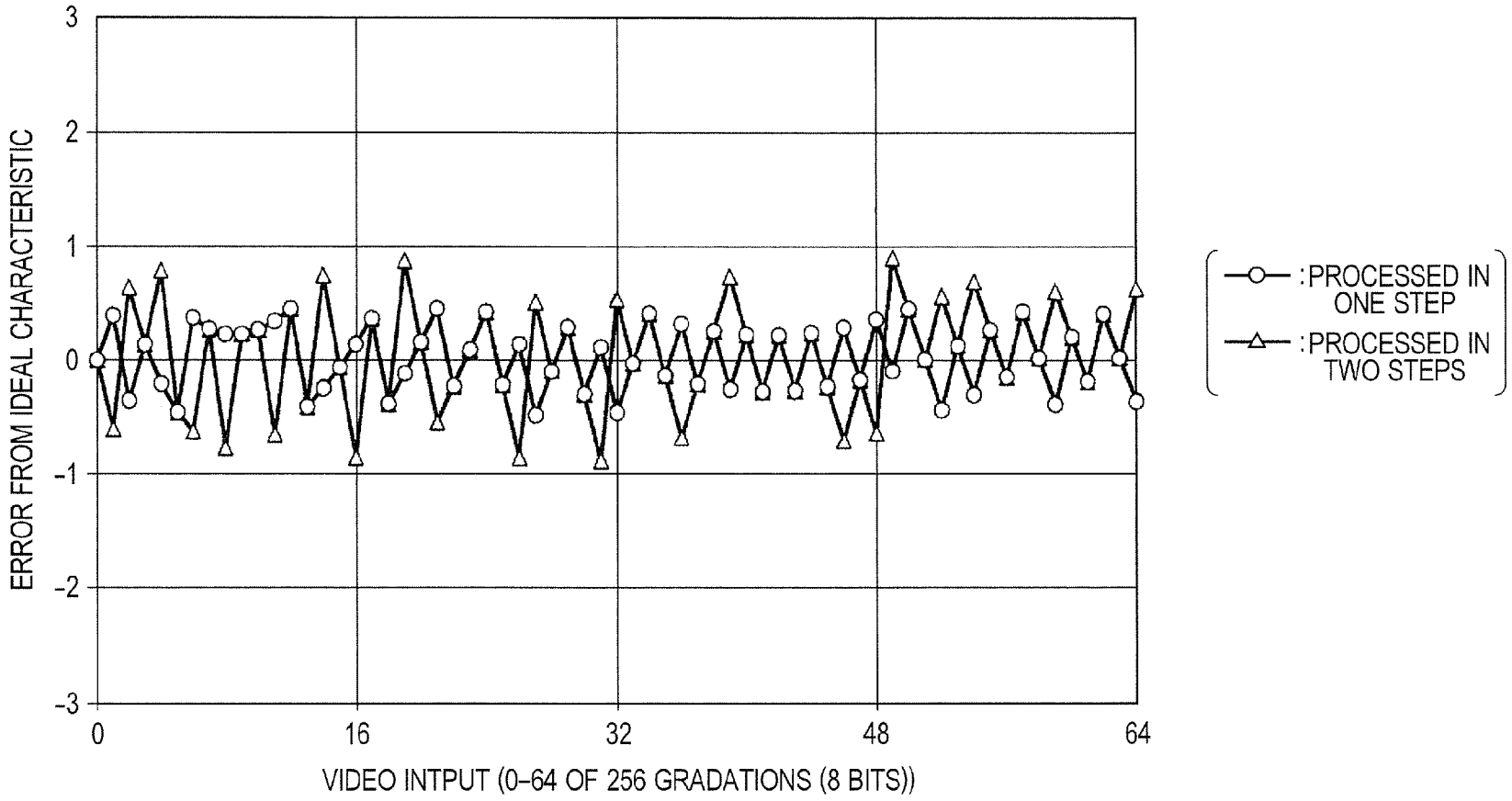
FIG. 17 is a graph illustrating error characteristics in a video output signal.

The total gain value which takes into consideration the fixed gamma characteristic for the luminance enhancement as well in addition to the gain value set by the peak ACL control is supplied to the luminance modulator 1. Therefore, it is possible to enhance the visibility-wise luminance. The luminance modulation processing can be performed only once; therefore, the gradation properties do not deteriorate as compared with those in the luminance modulation processing of the comparative example 2 which is performed twice. The luminance modulation processing is performed in units of pixels of a video signal, and it is natural to treat a high resolution video signal such as a full high definition picture (1920×1080) in these days. Therefore, the luminance modulation processing demands the high-speed processing capability; accordingly, the ordinary processing is performed by hardware, such as a one-dimensional look-up table (1D-LUT). However, the problem is that a large-scale hardware processing is costly; therefore, it is generally restricted to processing by 8 bits or so. When, in the state where the signal is restricted to 8 bits or so as described above, the comparison is made between the multiple processing such as two-step processing and the single processing performed after combining two modulation gains as the total gain in advance, the single processing can suppress the gradation degradation better, as illustrated in FIG. 16 and FIG. 17. FIG. 16 is a graph illustrating an example of input-output characteristics of the image processing device 100, and FIG. 17 is a graph illustrating error characteristics in a video output signal at that time. In FIG. 16, the horizontal axis shows the video input and the vertical axis shows the video output, both expressed in terms of the gradation level. The full level is 256 gradations (8 bits). The horizontal axis shows 0-64 gradations of the 256 gradations, and the vertical axis shows the corresponding 0-128 gradations. Circular plots show the input-output characteristics of the single processing (processed in one step) as in Embodiment 2, and triangular plots show the input-output characteristics of the multiple processing (processed in two steps) as in the comparative example 2. In FIG. 17, the horizontal axis shows the gradation level of the video input, and the vertical axis shows an error from an ideal characteristic in the corresponding video output. Circular plots show the error characteristics in the single processing (processed in one step) as in Embodiment 2, and triangular plots show the error characteristics in the multiple processing (processed in two steps) as in the comparative example 2. Compared with the error of ±1 LSB in the multiple processing (processed in 2 steps) as in the comparative example 2, the error in the single processing (processed in one step) as in Embodiment 2 is suppressed to ±0.5 LSB. As a result, when man views the screen display, the gradation part in which the luminance change is gradual as in an evening glow picture can be viewed as a beautiful gradation picture in which the luminance change is continuous, without being recognized as luminance step noises such as solarization.

In Embodiment 2, the total modulation gain is calculated in advance. In the calculation, it is sufficient to perform one arithmetic to each gradation level per one picture (per frame). Therefore, for example, in the case of performing the luminance modulation to an 8-bit video signal, the calculation completes with 256 steps of arithmetic; accordingly, when the system is implemented by software, there are few restrictions of the processing time to the performance. Also when the system is implemented by hardware, it suffices that only the total control gain calculation unit is enhanced in accuracy to 16 bits or so. Therefore, as compared with implementing the whole video signal path in 16 bits, there is little cost influence due to the scale enlargement. Because of this, Embodiment 2 is a very effective technique also in the implementation.

The backlight structure of the display unit to which Embodiment 2 can be applied includes not only the control-system structure of a single light source but the control-system structure of multiple light sources. When the gamma correction can be controlled in units of a local area by the multiple light sources, the gamma characteristic is individually set up in units of the local area.

In particular, Embodiment 2 manifests its effect when applied to an in-vehicle apparatus. An in-vehicle apparatus is viewed under the bright external light environment in daytime or outdoor where the picture visibility is poor; therefore, it requires the enhancement effect of the luminance from the viewpoint of visual recognition. Furthermore, the reduction effect of power consumption is required by a battery-operated vehicle, such as an EV (Electrical Vehicle) and an HV (Hybrid Vehicle). In viewing the apparatus such as a DTV in which high definition display is important, the reproduction of luminance linearity of the original gamma characteristic such as the power of 2.2 is important. However, the reproduction of luminance linearity is not important in the viewing in the in-vehicle environment; accordingly, the gamma processing by the small gamma characteristic or the S-curve characteristic does not cause any practical problem, and obtaining the luminance enhancement effect becomes rather important.

Embodiment 3

Black Level Correction

Figure 18:
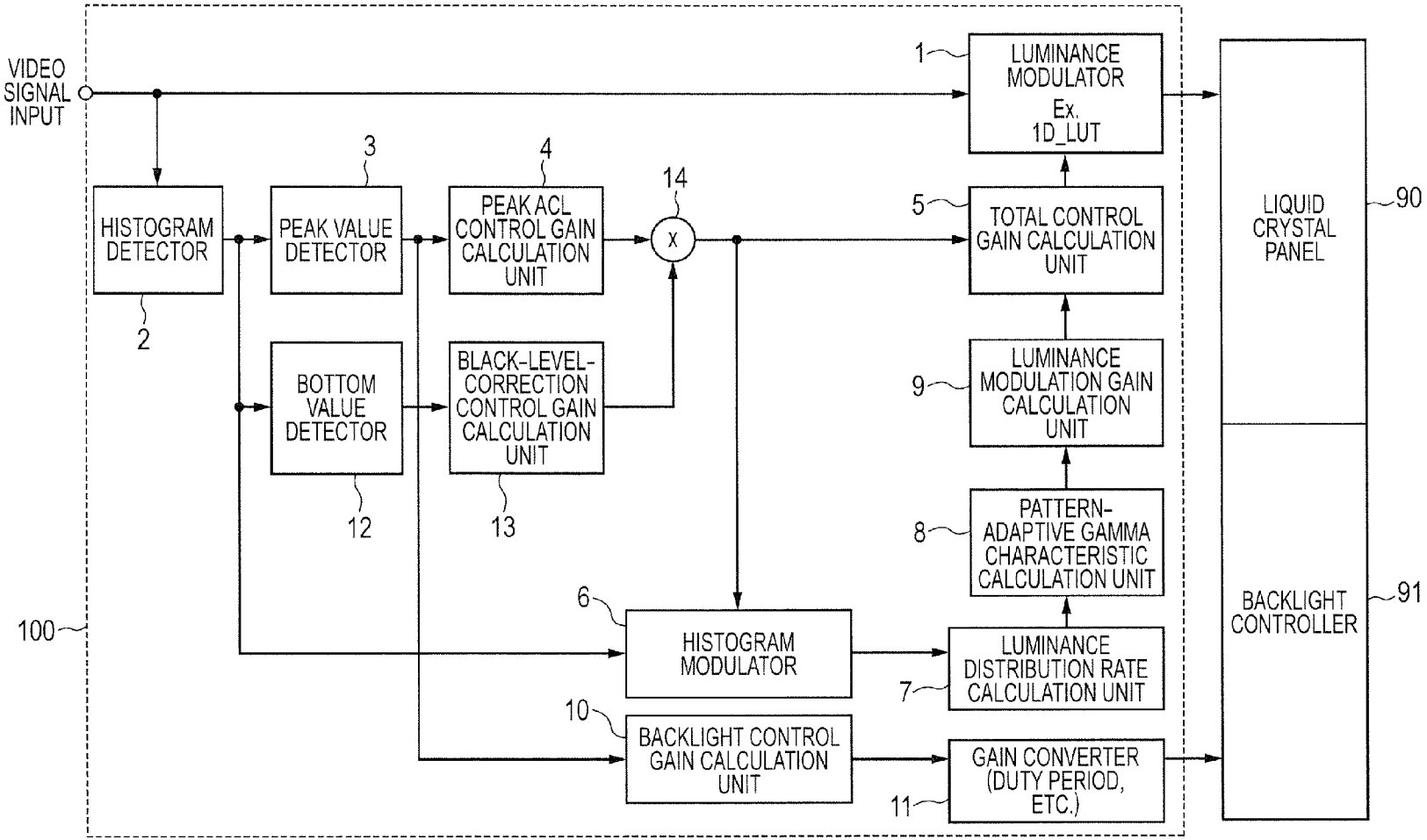
FIG. 18 is a block diagram illustrating an example of a configuration of an image processing device according to Embodiment 3.

FIG. 18 is a block diagram illustrating an example of a configuration of an image processing device according to Embodiment 3.

As is the case with Embodiment 1, a video signal is inputted into the image processing device 100 according to Embodiment 3. The image processing device calculates a video output signal to be supplied to a coupled display panel 90 such as a liquid crystal and a backlight control signal to be supplied to a backlight controller 91 attached to the display panel 90. Moreover, as is the case with Embodiment 1, the image processing device 100 includes a luminance modulator 1, a histogram detector 2, a peak value detector 3, a peak ACL control gain calculation unit 4, a histogram modulator 6, a luminance distribution rate calculation unit 7, a pattern-adaptive gamma calculation unit 8, a luminance modulation gain calculation unit 9, a total control gain calculation unit 5, a backlight control gain calculation unit 10, and a gain converter 11. The image processing device 100 according to Embodiment 3 further includes a bottom value detector 12, a black-level-correction control gain calculation unit 13, and a multiplier 14. The same elements as those of the image processing device 100 illustrated in Embodiment 1 have the same function, therefore, the explanation thereof is omitted.

The bottom value detector 12 detects a bottom value which is the lowest (darkest) value in a video signal. In the same manner as in the peak value detection, it is possible to adopt a method in which a histogram detected by the histogram detector is accumulated sequentially from the lowest picture level and the picture level with which the accumulated value reaches a preset value is detected as the bottom value. For example, assuming that the total pixel number in one picture (one frame) is 100%, a picture level with which the accumulated value of the histogram reaches 3% is detected as the bottom value. A method of detecting a bottom value directly without using the histogram detection result yields extremely poor detection stability when only several pixels exhibit a spiky low level as uniquely observed in a noisy picture. On the other hand, the method of calculating a bottom value from the accumulated value of a histogram maintains the suitable detection stability.

Figure 19:
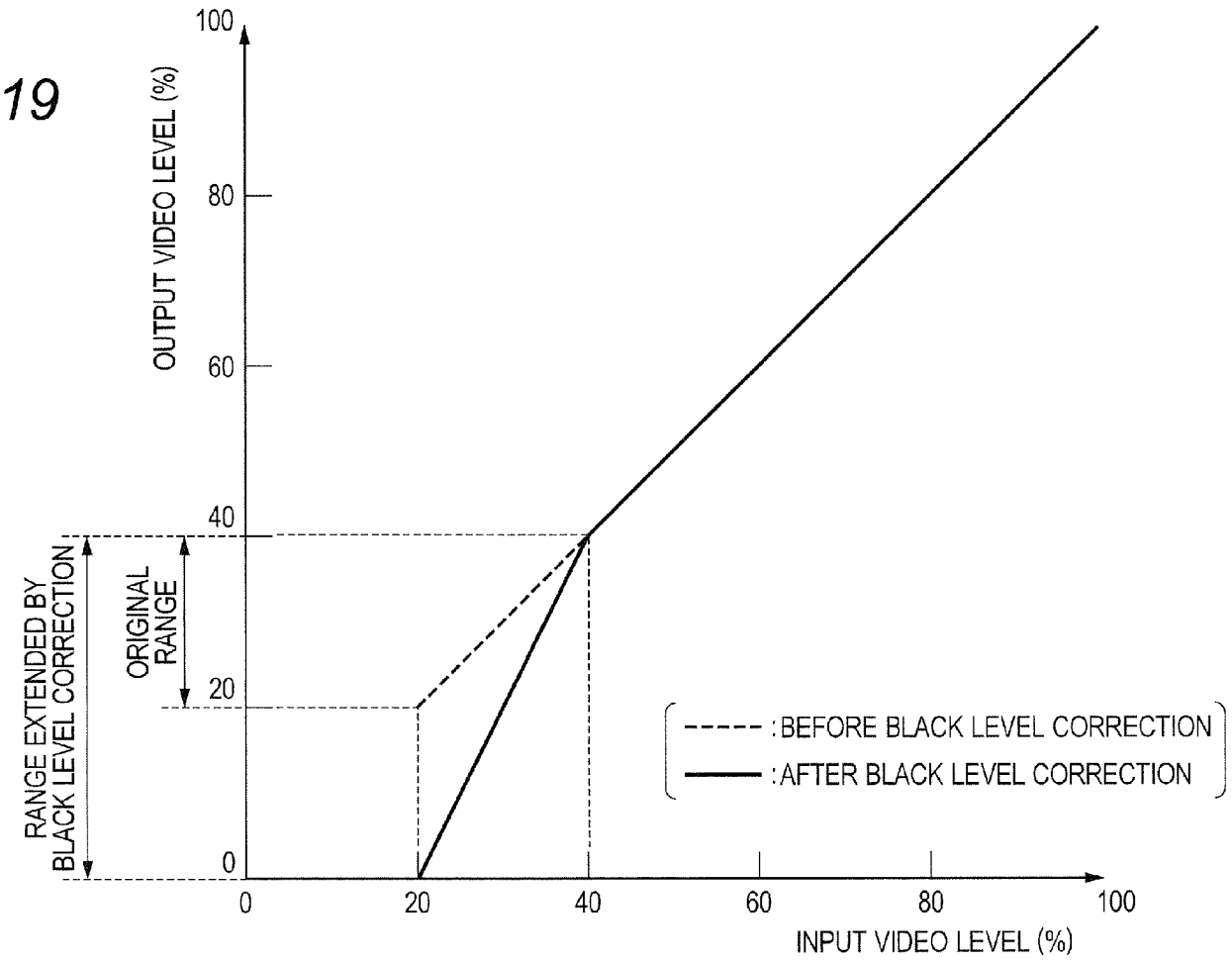
FIG. 19 is an explanatory drawing illustrating black level correction.

The black-level-correction control gain calculation unit 13 calculates a gain corresponding to this bottom value. FIG. 19 is an explanatory drawing illustrating black level correction. The horizontal axis shows an input video level and the vertical axis shows an output video level, both expressed in the relative value (%) to the full scale which is assumed to be 100%. When the input video level has pixels only in a picture level region of 20% or greater, namely, when the bottom value is 20%, a range of 20%-40% of the input video level (original range) is extended to a range of 0%-40% of the output video level. This indicates that the picture level at 20% is drawn into the level at 0% (black). Such a correction is called the black level correction or the black level extension. The multiplier in the next stage multiplies the gain value obtained from the peak ACL control gain calculation unit by the gain value obtained from the black-level-correction control gain calculation unit.

When focusing attention only on the low luminance side, the peak ACL control alone increases (brightens) the picture level, yielding an opposite effect in the implications of the contrast enhancement. The contrast enhancement here aims at enhancing man's relative sensitivity by making a bright picture brighter and a dark picture darker. By multiplying the peak ACL control by the effect of the black level correction as described above, even if the video input signal has any peak value and any bottom value, the video output signal always ranges in principle over the picture levels of 0%-100%, leading to the most effective use of the dynamic range. In the subsequent stage of this processing, by performing the picture pattern-adaptive gamma correction process according to Embodiment 1, it is possible to obtain a more effective contrast enhancement and luminance enhancement. Alternatively, it is also preferable to perform the fixed gamma characteristic processing according to Embodiment 2.

Embodiment 4

Readjustment Based on the Visibility-Wise Luminance Enhancement Amount

Figure 20:
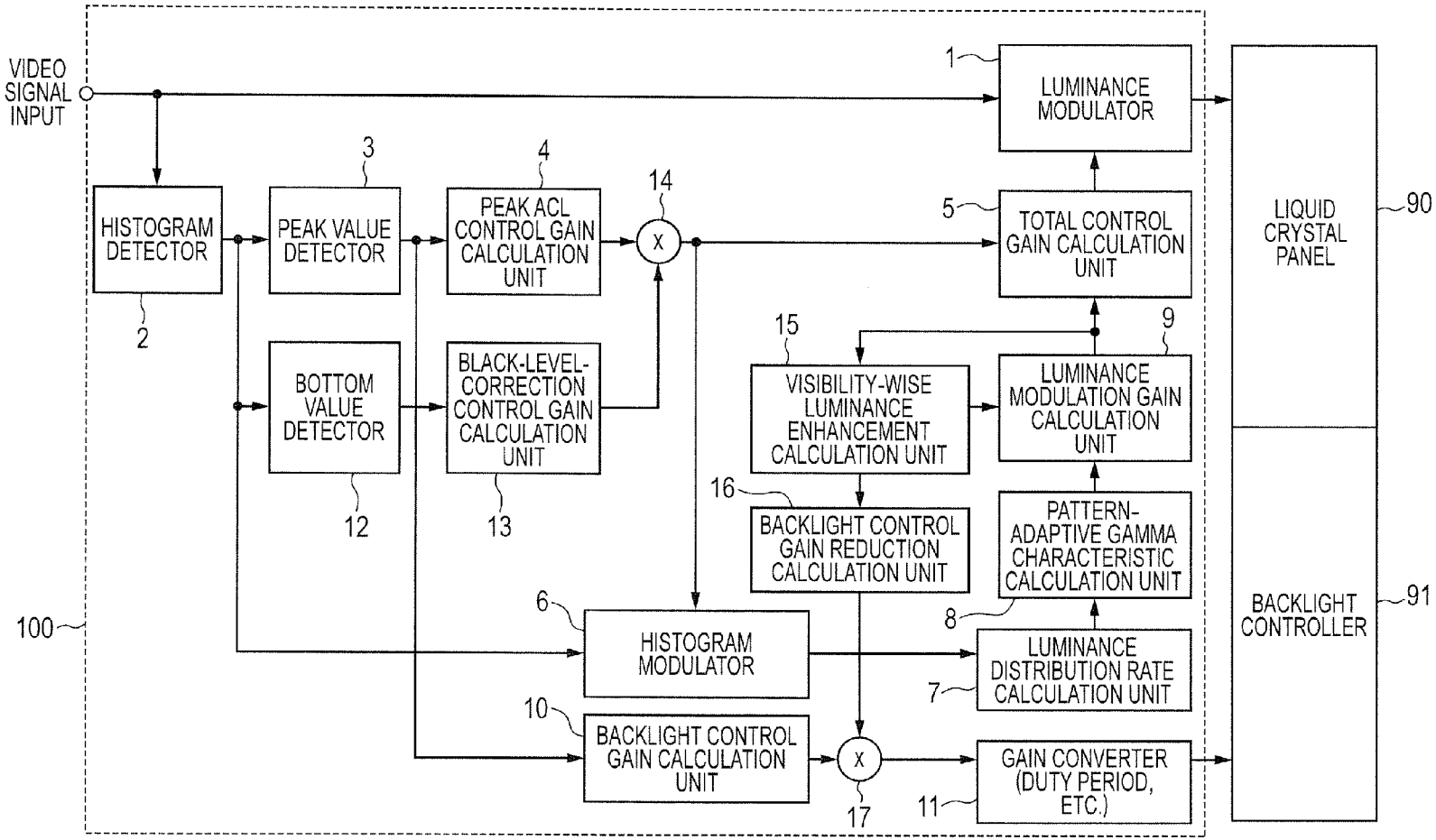
FIG. 20 is a block diagram illustrating an example of a configuration of an image processing device according to Embodiment 4.

FIG. 20 is a block diagram illustrating an example of a configuration of an image processing device according to Embodiment 4.

As is the case with Embodiment 1, a video signal is inputted into the image processing device 100 according to Embodiment 4. The image processing device calculates a video output signal to be supplied to a coupled display panel 90 such as a liquid crystal and a backlight control signal to be supplied to a backlight controller 91 attached to the display panel 90. As is the case with Embodiment 1, the image processing device 100 includes a luminance modulator 1, a histogram detector 2, a peak value detector 3, a peak ACL control gain calculation unit 4, a histogram modulator 6, a luminance distribution rate calculation unit 7, a pattern-adaptive gamma calculation unit 8, a luminance modulation gain calculation unit 9, a total control gain calculation unit 5, a backlight control gain calculation unit 10, and a gain converter 11. As is the case with Embodiment 3, the image processing device 100 according to Embodiment 4 further includes a bottom value detector 12, a black-level-correction control gain calculation unit 13, and a multiplier 14. The image processing device 100 according to Embodiment 4 further includes a visibility-wise luminance enhancement calculation unit 15, a backlight control gain reduction calculation unit 16, and a multiplier 17. The same elements as those of the image processing device 100 illustrated in Embodiment 1 and Embodiment 3 have the same function, therefore, the explanation thereof is omitted.

The visibility-wise luminance enhancement calculation unit 15 calculated quantitatively the amount of visibility-wise luminance enhancement effect obtained by Embodiments 1-3. The simplest method for this calculation is to calculate the amount of increase in the average luminance levels, such as the APL, due to the luminance modulation by the gamma correction, as the amount of luminance enhancement effect. As a method of calculating more exactly the amount of luminance enhancement effect, various models such as a color appearance model are proposed which quantizes the way of viewing of "luminance" and "depth of a color", in consideration of the visibility characteristic of human beings. By comparing the quantitative values obtained from these models before and after the luminance modulation by the gamma correction, it is possible to utilize the change of the quantitative values as the amount of luminance enhancement effect. From the quantitative value of the luminance enhancement effect, the backlight control gain reduction calculation unit 16 determines the amount of further reduction of the backlight luminance to the amount of reduction of the backlight luminance obtained from the peak value detected by the peak value detector 3. For example, when the amount of luminance enhancement effect is calculated as 30%, the amount of reduction is calculated so that the backlight luminance is made darker by 30%. In the present case, while maintaining the same visibility-wise luminance as the state where the backlight control correction is not performed, the backlight luminance can be reduced more than by the backlight control in the related art. However, it is not necessary to allot all the amount of luminance enhancement effect to the reduction of the backlight luminance (lower power consumption). In the example described above, it is possible to adopt an utilizing method in which, when the amount of luminance enhancement effect is calculated as 30%, 15% is allotted to the amount of further reduction of the backlight luminance and 15% is left as the amount of luminance enhancement effect. The final amount of backlight control is determined in the multiplier 17 which multiplies the gain value obtained from the backlight control gain calculation unit 10 in the next stage by the amount of reduction obtained from the backlight control gain reduction calculation unit 16. When the calculation of the visibility-wise luminance enhancement amount clarifies that there is no luminance enhancement effect or that there is darkening effect conversely, as another utilizing method, the information is given to the pattern-adaptive gamma control gain calculation unit 9, and any gamma correction and any further reduction of the back light electric power are not performed.

FIG. 20 illustrates the image processing device 100 provided with the black level correction function, as is the case with Embodiment 3. However, this function may be omitted. Furthermore, the image processing device 100 is provided with the pattern-adaptive gamma correction function, as is the case with Embodiment 1. However, in lieu of this function, it is preferable to adopt the user-defined gamma correction function as is the case with Embodiment 2.

The effect of Embodiment 4 is listed in the following. In a product carrying a liquid crystal panel, various design constraints with respect to layout are imagined. The design constraints indicate difficulties in securing a heat release space and taking measures for heat release design such as installation of a fan. In this case, it is necessary to reduce a heat-generation level by reducing the power consumption of the system including the liquid crystal panel, thereby coping with the design constraints. The backlight control system in the related art has the characteristic of holding the original display luminance; therefore, it is difficult to reduce the back light electric power fundamentally when a video signal having a peak (100%) picture level is supplied. However, by allotting the amount of visibility-wise luminance enhancement effect to the amount of reduction of the backlight luminance, it is possible to reduce the back light electric power even when a signal having a peak (100%) picture level is supplied. Accordingly, it is possible to steadily produce the power reduction effect and to suppress the heating value of the system, thereby contributing to enhancement of the design flexibility in the layout including the minimization of space and the elimination of a fun. The luminance at a spot displaying the peak level in the display screen decreases as compared with a case where no measures are taken; however, it becomes possible to obtain the power reduction effect for almost all video signals including a signal having the peak level. In viewing the apparatus such as a DTV or a mobile in which high definition display is important, the luminance reproduction at a spot displaying a peak level is important performance. However, in the viewing in the in-vehicle environment where the design constraints with respect to layout is particularly severe, the luminance reproduction at a spot displaying a peak level is not comparatively important, and does not pose any problem in the practical use. Therefore, it is more important to acquire the most required effect of the luminance enhancement and the power reduction.

As described above, the invention accomplished by the present inventors has been concretely explained based on the embodiments. However, it cannot be overemphasized that the present invention is not restricted to the embodiments as described above, and it can be changed variously in the range which does not deviate from the gist.

For example, the functional partition shown in each block diagram is an example, and it may be changed into another functional block which unifies the equivalent function or which is a subdivided functional partition. It is preferable to adopt an image processing method or an image processing device which utilizes the control by the product of a supply voltage of a self-luminescence type display device and the degree of modulation of PWM (Pulse Width Modulation) for example, in lieu of the control by the product of the transmissivity of the liquid crystal and the luminance of the backlight. When the supply voltage of the self-luminescence type display device is associated with the backlight and the degree of modulation of the PWM is associated with the transmissivity of the liquid crystal, it is possible to apply the technical thought of the identical gist.

What is claimed is:

1. An image processing device comprising:

a luminance modulator operable to receive a video input signal and operable to calculate a video output signal to be supplied to a display panel coupled;

a backlight control gain adjustment unit operable to calculate a backlight control signal to be supplied to a backlight controller provided in the display panel;

a peak value detector operable to calculate a peak value as a maximum luminance value in a prescribed region of the video input signal;

a histogram detector operable to calculate frequency distribution about the luminance value of the video input signal in the prescribed region, wherein the luminance modulator converts a luminance value of the video input signal into a luminance value of the video output signal for every pixel, based on the peak value and the frequency distribution, and wherein the backlight control gain adjustment unit calculates the backlight control signal based on the peak value;

a peak Automatic contrast level (ACL) control gain calculation unit;

a pattern-adaptive gamma characteristic calculation unit; and a total control gain calculation unit, wherein the peak ACL control gain calculation unit calculates a peak ACL control gain with which the luminance of each pixel of the video input signal is amplified, based on a ratio of the peak value to the maximum possible value of the video output signal, wherein the pattern-adaptive gamma characteristic calculation unit calculates a luminance modulation gain with which the luminance of each pixel of the video input signal is modulated, based on the frequency distribution, wherein the total control gain calculation unit calculates a product of the peak ACL control gain and the luminance modulation gain as a total control gain, and wherein the luminance modulator converts the luminance value of the video input signal into the luminance value of the video output signal for every pixel based on the total control gain.

2. The image processing device according to claim 1, wherein the pattern-adaptive gamma characteristic calculation unit calculates the luminance modulation gain based on at least one of a first function, a second function, and a third function, wherein the first function has no point of inflection and enhances the luminance for every pixel of the video input signal, wherein the second function has one point of inflection and enhances the luminance about a high luminance pixel above a barycenter of the frequency distribution among the video input signal, and reduces the luminance about a low luminance pixel below the barycenter, and wherein the third function linearizes the relation of a cumulative value of the frequency to a luminance value of the frequency distribution.

3. The image processing device according to claim 2 further comprising:

a frequency distribution rate calculation unit, wherein, when no localized distribution is observed in the frequency distribution, the frequency distribution rate calculation unit derives the first function and supplies it to the pattern-adaptive gamma characteristic calculation unit, wherein, when the frequency distribution is locally distributed at one place, the frequency distribution rate calculation unit derives the second function and supplies it to the pattern-adaptive gamma characteristic calculation unit, and wherein, when the frequency distribution is locally distributed at several regions, the frequency distribution rate calculation unit derives the third function with which a gamma value is specified based on the cumulative value of the frequency in the frequency distribution, and supplies the third function to the pattern-adaptive gamma characteristic calculation unit.

4. The image processing device according to claim 1 further comprising:

a bottom value detector operable to calculate a bottom value as a minimum luminance value of the video input signal in a prescribed region, wherein the luminance modulator converts a luminance value of the video input signal into a luminance value of the video output signal for every pixel, based on the peak value and the frequency distribution, and additionally based on the bottom value.

5. The image processing device according to claim 1, wherein the image processing device evaluates the enhancement amount of the luminance value of the video output signal to the luminance value of the video input signal, the enhancement being performed by the luminance modulator based on the frequency distribution, and readjusts the backlight control signal based on the enhancement amount, the backlight control signal being created by the backlight control gain adjustment unit based on the peak value.

6. The image processing device according to claim 1, wherein the image processing device evaluates the enhancement amount of the luminance value of the video output signal to the luminance value of the video input signal, the enhancement being performed by the luminance modulator based on the frequency distribution, and readjusts the backlight control signal based on the enhancement amount, and wherein, in lieu of or combining with the readjustment, the luminance modulator converts the luminance value of the video input signal into the luminance value of the video output signal for every pixel, based on the peak value and the frequency distribution, and additionally based on the enhancement amount.

7. The image processing device according to claim 1, wherein the backlight controller adjusts a backlight luminance for every region corresponding to the prescribed region, and wherein the backlight control gain adjustment unit calculates a backlight control signal to adjust the backlight luminance of the region corresponding to the prescribed region.

8. The image processing device according to claim 1 further comprising:

a processor operable to execute software, wherein the processor performs the operation of the luminance modulator and the backlight control gain adjustment unit by executing the specified software.

9. The image processing device according to claim 1, wherein a generation of a quantization error to the video signal is suppressed to a smaller amount than performing sequentially a conversion using the luminance modulation gain, and a conversion using luminance modulation gain.

10. An image processing device comprising:

a luminance modulator operable to receive a video input signal and operable to calculate a video output signal to be supplied to a display panel coupled;

a backlight control gain adjustment unit operable to calculate a backlight control signal to be supplied to a backlight controller provided in the display panel;

a peak value detector operable to calculate a peak value as a maximum luminance value in a prescribed region of the video input signal;

a histogram detector operable to calculate frequency distribution about the luminance value of the video input signal in the prescribed region, wherein the luminance modulator converts a luminance value of the video input signal into a luminance value of the video output signal for every pixel, based on the peak value and the frequency distribution, and wherein the backlight control gain adjustment unit calculates the backlight control signal based on the peak value;

a peak Automatic contrast level (ACL) control gain calculation unit;

a pattern-adaptive gamma characteristic calculation unit; and a total control gain calculation unit, wherein the peak ACL control gain calculation unit calculates a peak ACL control gain with which the luminance of each pixel of the video input signal is amplified, based on a ratio of the peak value to the maximum possible value of the video output signal, wherein the pattern-adaptive gamma characteristic calculation unit calculates a luminance modulation gain with which the luminance of each pixel of the video input signal is modulated, based on the frequency distribution, wherein the total control gain calculation unit calculates a product of the peak ACL control gain and the luminance modulation gain as a total control gain, wherein the luminance modulator converts the luminance value of the video input signal into the luminance value of the video output signal for every pixel based on the total control gain, wherein the pattern-adaptive gamma characteristic calculation unit calculates the luminance modulation gain based on at least one of a first function, a second function, and a third function, wherein the first function has no point of inflection and enhances the luminance for every pixel of the video input signal, wherein the second function has one point of inflection and enhances the luminance about a high luminance pixel above a barycenter of the frequency distribution among the video input signal, and reduces the luminance about a low luminance pixel below the barycenter, wherein the third function linearizes the relation of a cumulative value of the frequency to a luminance value of the frequency distribution, and wherein the frequency distribution rate calculation unit derives the first function, the second function, and the third function in parallel, derives further a fourth function by weighting addition of the first function, the second function, and the third function, and supplies the fourth function to the pattern-adaptive gamma characteristic calculation unit, in lieu of the first function, the second function, and the third function.

11. The image processing device according to claim 10, wherein the frequency distribution rate calculation unit adjusts the weighting of the first function, the second function, and the third function, based on the frequency distribution.

12. An image processing device comprising:

a luminance modulator operable to receive a video input signal and operable to calculate a video output signal to be supplied to a display panel coupled;

a backlight control gain adjustment unit operable to calculate a backlight control signal to be supplied to a backlight controller provided in the display panel;

a peak value detector operable to calculate a peak value as a maximum luminance value in a prescribed region of the video input signal; and a histogram detector operable to calculate frequency distribution about the luminance value of the video input signal in the prescribed region, wherein the luminance modulator converts a luminance value of the video input signal into a luminance value of the video output signal for every pixel, based on the peak value and the frequency distribution, and wherein the backlight control gain adjustment unit calculates the backlight control signal based on the peak value;

a peak Automatic contrast level (ACL) control gain calculation unit;

a pattern-adaptive gamma characteristic calculation unit; and a total control gain calculation unit, wherein the peak ACL control gain calculation unit calculates a peak ACL control gain with which the luminance of each pixel of the video input signal is amplified, based on a ratio of the peak value to the maximum possible value of the video output signal, wherein the pattern-adaptive gamma characteristic calculation unit calculates a luminance modulation gain with which the luminance of each pixel of the video input signal is modulated, based on the frequency distribution, wherein the total control gain calculation unit calculates a product of the peak ACL control gain and the luminance modulation gain as a total control gain, wherein the luminance modulator converts the luminance value of the video input signal into the luminance value of the video output signal for every pixel based on the total control gain, wherein the pattern-adaptive gamma characteristic calculation unit calculates the luminance modulation gain based on at least one of a first function, a second function, and a third function, wherein the first function has no point of inflection and enhances the luminance for every pixel of the video input signal, wherein the second function has one point of inflection and enhances the luminance about a high luminance pixel above a barycenter of the frequency distribution among the video input signal, and reduces the luminance about a low luminance pixel below the barycenter, and wherein the third function linearizes the relation of a cumulative value of the frequency to a luminance value of the frequency distribution, said image processing device further comprising:

a frequency distribution rate calculation unit, wherein, when no localized distribution is observed in the frequency distribution, the frequency distribution rate calculation unit derives the first function and supplies it to the pattern-adaptive gamma characteristic calculation unit, wherein, when the frequency distribution is locally distributed at one place, the frequency distribution rate calculation unit derives the second function and supplies it to the pattern-adaptive gamma characteristic calculation unit, wherein, when the frequency distribution is locally distributed at several regions, the frequency distribution rate calculation unit derives the third function with which a gamma value is specified based on the cumulative value of the frequency in the frequency distribution, and supplies the third function to the pattern-adaptive gamma characteristic calculation unit, and wherein the frequency distribution rate calculation unit evaluates the feature of the video input signal, based on the weighted frequency distribution which is obtained by multiplying a pretreatment function specifying the weighting corresponding to the luminance value of the video input signal to the frequency distribution.

13. An image processing device comprising:

a luminance modulator operable to receive a video input signal and operable to calculate a video output signal to be supplied to a display panel coupled;

a backlight control gain adjustment unit operable to calculate a backlight control signal to be supplied to a backlight controller provided in the display panel;

a peak value detector operable to calculate a peak value as a maximum luminance value of the video input signal in a prescribed region;

a peak Automatic contrast level (ACL) control gain calculation unit operable to calculate a peak ACL control gain with which the luminance of each pixel of the video input signal is amplified, based on the ratio of the peak value to the maximum possible value of the video output signal;

a gamma characteristic calculation unit operable to calculate a luminance modulation gain with which the luminance of each pixel of the video input signal is modulated; and a total control gain calculation unit operable to calculate the product of the peak ACL control gain and the luminance modulation gain as a total control gain, wherein the luminance modulator converts the luminance value of the video input signal into the luminance value of the video output signal for every pixel based on the total control gain, and wherein the backlight control gain adjustment unit calculates the backlight control signal based on the peak value.

14. The image processing device according to claim 13 further comprising:

a histogram detector operable to calculate frequency distribution about the luminance value of the video input signal in the prescribed region, wherein the gamma characteristic calculation unit calculates the luminance modulation gain based on the frequency distribution.

15. The image processing device according to claim 14, wherein the gamma characteristic calculation unit calculates the luminance modulation gain based on at least one of a first function, a second function, and a third function, wherein the first function has no point of inflection and enhances the luminance for every pixel of the video input signal, wherein the second function has one point of inflection and enhances the luminance about a high luminance pixel above a barycenter of the frequency distribution among the video input signal, and reduces the luminance about a low luminance pixel below the barycenter, and wherein the third function linearizes the relation of a cumulative value of the frequency to a luminance value of the frequency distribution.

* * * * *